US007963226B2

(12) United States Patent
Schneider et al.

(10) Patent No.: US 7,963,226 B2
(45) Date of Patent: Jun. 21, 2011

(54) METHOD FOR OPERATING A PRINTING UNIT HAVING AT LEAST ONE PRESS UNIT, AND A PRESS UNIT FOR CARRYING OUT THE METHOD

(75) Inventors: Georg Schneider, Würzburg (DE); Bernd Kurt Masuch, Kürnach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 124 days.

(21) Appl. No.: 12/312,868

(22) PCT Filed: Oct. 18, 2007

(86) PCT No.: PCT/EP2007/061160

§ 371 (c)(1), (2), (4) Date: May 29, 2009

(87) PCT Pub. No.: WO2008/064960

PCT Pub. Date: Jun. 5, 2008

(65) Prior Publication Data

US 2010/0024673 A1 Feb. 4, 2010

(30) Foreign Application Priority Data

Dec. 1, 2006 (DE) ..... 10 2006 056 830
Jun. 22, 2007 (DE) ..... 10 2007 028 955

(51) Int. Cl.
*B41F 21/00* (2006.01)

(52) U.S. Cl. ..... 101/486; 101/415.1

(58) Field of Classification Search ..... 101/382.1, 101/383, 385, 386, 415.1, 485, 486
See application file for complete search history.

(56) References Cited

U.S. PATENT DOCUMENTS 5,595,119 A * 1/1997 Hada et al. ..... 101/477
6,293,193 B1 9/2001 Bolza-Schunemann
6,502,508 B1 1/2003 Schaede et al.
6,736,065 B2 5/2004 Naniwa (Continued)

FOREIGN PATENT DOCUMENTS

DE 261 769 A1 11/1988

(Continued)

*Primary Examiner* — Ren Yan
(74) *Attorney, Agent, or Firm* — Jones, Tullar & Cooper, P.C.

(57) ABSTRACT

A printing unit has at least one press unit having a plate cylinder with at least one printing plate that can be mounted on the plate cylinder and which carries a printing image. The plate cylinder has at least one cylinder channel in which ends of the printing plate can be fixed or positioned. The printing plate has a leading angled end and also has a trailing angled end, as viewed in the direction of rotation of the printing cylinder during operation of the printing press. The printing plate can be secured to the plate cylinder by insertion of the plate leading end into the cylinder channel and by insertion of the plate trailing end into the same, or another cylinder channel. Initially, the plate trailing end is fixed in its associated cylinder channel and the plate cylinder is rotated in a rotational direction counter to a production direction. The leading plate end is then fixed in its associated cylinder channel during continued rotation of the plate cylinder opposite to a production direction. Once the printing plate is secured, the printing cylinder is rotated in its production direction.

17 Claims, 23 Drawing Sheets

U.S. PATENT DOCUMENTS

| | | | | |
|---|---|---|---|---|
| 6,786,151 | B2 | 9/2004 | Stiel | |
| 6,854,392 | B2 | 2/2005 | Tobe | |
| 6,973,876 | B2 | 12/2005 | Nakano et al. | |
| 7,156,019 | B2 | 1/2007 | Herbert et al. | |
| 7,367,265 | B2 * | 5/2008 | Zink | 101/415.1 |
| 2005/0172846 | A1 | 8/2005 | Schneider et al. | |

FOREIGN PATENT DOCUMENTS

| | | | |
|---|---|---|---|
| DE | 40 03 445 | C2 | 8/1991 |
| DE | 197 56 796 | A1 | 7/1999 |
| DE | 198 04 106 | A1 | 8/1999 |
| DE | 10 2004 052 020 | A1 | 5/2006 |
| DE | 10 2004 052 021 | A1 | 5/2006 |
| DE | 10 2005 029 167 | A1 | 12/2006 |
| DE | 10 2006 028 434 | A1 | 12/2006 |
| DE | 10 2005 042 756 | A1 | 3/2007 |
| DE | 10 2005 046 303 | A1 | 3/2007 |
| DE | 10 2006 004 330 | B3 | 4/2007 |
| EP | 1 127 687 | A2 | 8/2001 |
| EP | 1 391 300 | A1 | 2/2004 |
| EP | 1 435 292 | A1 | 7/2004 |
| EP | 1 491 337 | A1 | 12/2004 |
| GB | 2 206 536 | A | 1/1989 |
| GB | 2 279 909 | A | 1/1995 |
| WO | WO 00/41887 | A1 | 7/2000 |
| WO | WO 02/07972 | A1 | 1/2002 |
| WO | WO 03/031180 | A2 | 4/2003 |
| WO | WO 2004/085160 | A1 | 10/2004 |
| WO | WO 2006/136047 | A2 | 12/2006 |
| WO | WO 2007/028268 | A1 | 3/2007 |

* cited by examiner

METHOD FOR OPERATING A PRINTING UNIT HAVING AT LEAST ONE PRESS UNIT, AND A PRESS UNIT FOR CARRYING OUT THE METHOD

CROSS-REFERENCE TO RELATED APPLICATIONS

This application is the U.S. national phase, under 35 U.S.C. 371, of PCT/EP2007/061160, filed Oct. 18, 2007; published as WO 2008/064960 A1 on Jun. 5, 2008 and claiming priority to DE 10 2006 056 830.3 filed Dec. 1, 2006 and to DE 10 2007 028 955.5, filed Jun. 22, 2007, the disclosures of which are expressly incorporated herein by reference.

FIELD OF THE INVENTION

The present invention is directed to a method for operating a printing unit having at least one printing couple and is also directed to a printing couple for implementing the method. A printing couple of a printing unit includes a plate cylinder on which one or more printing plates can be mounted. A trailing plate end is initially mounted on the cylinder. The cylinder is then rotated in a direction counter to a production direction and the plate leading end is then fastened in the cylinder groove. A plate manipulation device may be provided.

BACKGROUND OF THE INVENTION

A device for use in changing the printing plates of a plate cylinders of a printing press that can have multiple plate cylinders is known from WO 2004/085160 A1. The plate changing device can comprise a storage device with an infeed chute and a removal chute. The storage device can be positioned above or below a horizontal plane that extends through the axis of rotation of each plate cylinder to which a storage device is assigned. The publication further describes a printing tower with U-printing units which are arranged one above another. A plate changing device with a storage device is assigned to each of the plate cylinders. The plate changing device for each of the respective plate cylinders is located above a horizontal plane that extends through the rotational axis of the assigned plate cylinder. This generally known plate changing device for each of the plate cylinders is always positioned in the same area around the circumference of the respective plate cylinder to which it is assigned. This positioning is possible with a U-printing unit because the plate cylinders of a printing unit, which are situated opposite one another and which can be operated from different sides of the side frame, rotate in opposite rotational directions during production.

DE 10 2004 052 021 A1 and DE 40 03 445 C2 both describe printing plate gripper devices with suction components.

EP 1 435 292 A1 describes devices for supplying printing plates to a flexographic satellite printing unit.

A printing plate with plate ends that are both bent at the same angle is known from DD 261 769 A1.

DE 197 56 796 A1 describes a sheet-fed printing press. The plate cylinders of this printing press support different printing plates on their respective circumferences.

The subsequently published WO 2006/136047 A2, the subsequently published DE 10 2005 029 167 A1 and the subsequently published DE 10 2005 042 756 A1 all describe printing plates with ends that are bent at the same angle.

The subsequently published DE 10 2005 046 303 A1, the subsequently published DE 10 2006 004 330 B3 and the subsequently published DE 10 2006 028 434 A1 and describe plate changing devices which are intended for use in connection with satellite printing units.

WO 02/07942 A1 shows a satellite printing unit with plate changing devices.

DE 10 2004 052 020 A1 discloses a method for operating a printing unit having at least one printing couple with a plate cylinder and having at least one printing plate which can be mounted on the plate cylinder and which at least one carries a print image. The printing plate is or can be fastened using a first angled end, which in print operation is its leading end, in a cylinder groove of a plate cylinder. The plate can also be fastened with a second angle end, which in print operation is its trailing end, in the same cylinder groove or in another cylinder groove which is provided on the plate cylinder.

The subsequently published DE 10 2005 042 756 A1 and WO 2007/028268 A1 both describe a process of rotating plate cylinder counter to the production direction during the mount of printing plates on those plate cylinders.

WO 03/031180 A2 discloses a nine-cylinder satellite printing unit. The plate cylinders of the printing unit are driven by position-controlled drive motors, independently of one another. The forme cylinders are loaded with printing formes using contact pressure devices.

DE 198 04 106 A1 discloses a printing unit having four printing couples. Every two cooperating printing couples are structured as blanket-to-blanket printing couples for double-sided printing of a web. To mount the printing formes on plate cylinders in the printing couples, in an upper printing couple, the top-side suspension angling of the printing forme is first placed in a clamping groove of the assigned forme cylinder, and in a lower printing couple, the bottom-side suspension angling of the printing forme is first placed in a clamping groove of the assigned forme cylinder. The printing formes are then mounted by rotating the forme cylinder in the rotation direction C or C', respectively. It is not disclosed how the rotational directions C and C' relate to the directions of rotation in production. Additionally, no reference is made to the second, lower printing couple.

SUMMARY OF THE INVENTION

The object of the present invention is to provide a method for operating a printing unit having at least one printing couple, and to provide a printing couple for use in implementing the method of the present invention.

The objects of the present invention are attained, in accordance with the present invention, by the provision of a printing unit having at least one printing couple that has a plate cylinder on which at least one printing plate can be mounted. The printing plate carries a print image to be printed. The printing plate is provided with a leading angled end and with a trailing angled end, both of which are receivable in a groove or in grooves in the plate cylinder. During mounting of such a plate, the trailing end is first mounted on the cylinder. The cylinder is then rotated in a direction counter to the production direction. The plate leading angled end is then inserted into its respective groove. The plate cylinder is then rotated in the production direction. A plate changing device, which is provided with at least one plate manipulation device, that includes at least one gripped element may be used to change the printing plates.

The benefits to be achieved in accordance with the invention consist especially in that it is now possible to assign plate changing devices that are identical in structure to all of the printing couples in a printing unit. This is true even in the case of satellite printing units, or in other words, in cases in which different and especially laterally opposite, plate cylinders of the printing unit have the same rotational directions, but are operated from opposite sides.

The present invention thus makes is possible to assign essentially identical plate changing devices to all of the plate cylinders of a printing unit or a printing tower. This can be done regardless of the respective direction of rotation of each plate cylinder during production operation. This allows a plate change to be performed extremely quickly, consequently increasing the productivity of the printing press. The identical structure of all of the plate changing devices that this invention enables also allows production costs to be decreased and handling to be simplified. Moreover, the implementation of the present invention allows a particularly compact construction for a nine-cylinder satellite printing unit.

The equal angling of each printing plate at both ends of all of the printing plates, and especially the angling of the plate ends at approximately 90°, as is provided in accordance with one aspect of the present invention, allows the production and the handling of the printing plates to be simplified. Moreover, the cylinder grooves which are provided in the printing cylinders can be symmetrical and can be configured the same in all of the various printing cylinders.

BRIEF DESCRIPTION OF THE DRAWINGS

Preferred embodiments of the present invention are represented in the set of drawings and will be specified in greater detail in what follows.

The drawings show, in:

FIG. 2*a* a detail view of the drive mechanism for the cylinder of a printing couple in a nine-cylinder satellite printing unit of FIG. 2;

DESCRIPTION OF THE PREFERRED EMBODIMENTS

Figure 1:
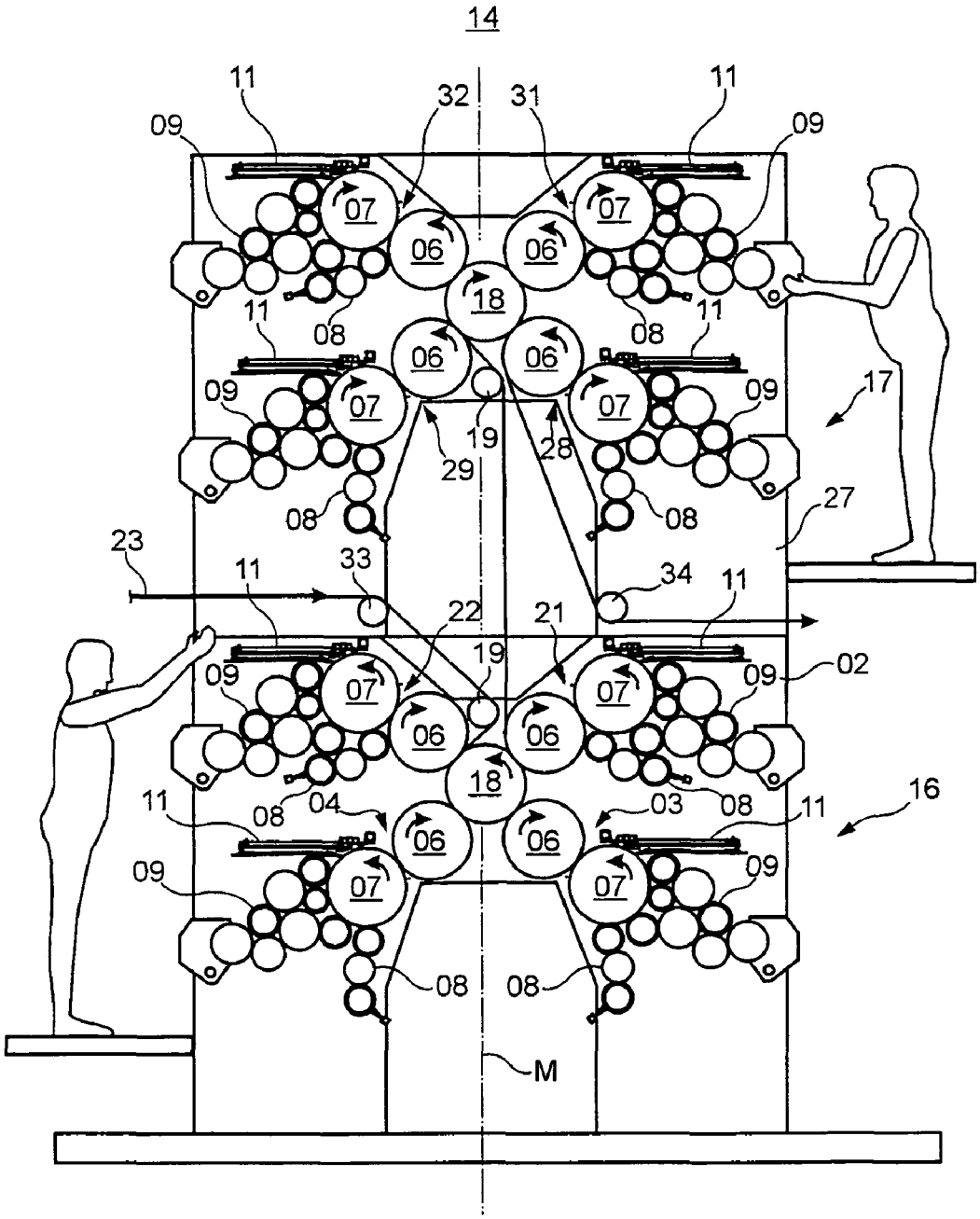
FIG. 1 a side elevation view of an eight-couple printing tower with two nine-cylinder satellite printing units arranged one above another, and having plate changing devices for all plate cylinders, in a production, i.e., a printing phase.

Referring initially to FIG. 1, there is depicted somewhat schematically a printing tower 14 which is configured as an eight-couple printing tower 14 and which is comprised of two printing units 16 and 17, such as, for example, two satellite printing units 16 and 17, and especially two nine-cylinder satellite printing units 16 and 17, such as, for example two, 6/2 printing units, arranged one above another. Each of the two printing units 16 and 17 have cylinders which hold one, two, three, four, five, six or eight plates side by side in an axial direction, for example, and which each hold one, two or four plates, one in front of another in a circumferential direction, for example. The lower nine-cylinder satellite printing unit 16, which is six plates in width, for example, comprises a frame 02, a cylinder 18, for example a satellite or impression cylinder 18, which is mounted on the frame 02, two lower printing couples 03; 04 that cooperate with the satellite cylinder 18, and two upper printing couples 21; 22 that also cooperate with the satellite cylinder 18.

Each printing couple 03; 04; 21; 22 in the lower nine-cylinder satellite printing unit 16 depicted in FIG. 1 comprises a cylinder 06, for example a transfer cylinder 06, which may be embodied as a blanket cylinder 06, a cylinder 07, for example a forme cylinder 07, which may be embodied as a plate cylinder 07, a dampening unit 08 that is assigned to the plate cylinder 07, and an inking unit 09 which is also assigned to the plate cylinder 07. The dampening units 08 can be brush dampening units, film dampening units, or spray dampening units, for example. In each case, two plate cylinders 07 are arranged lying at least substantially side by side in the horizontal direction. In each case, two plate cylinders 07 are arranged lying at least substantially one above another in the vertical direction. The same is true of the transfer cylinders 06, the axes of which transfer cylinders at least approximately define a square.

A guide roller 19 is arranged between the two upper printing couples 21; 22 and specifically between their transfer cylinders 06, as seen in FIG. 1, such that a web of print substrate or paper 23 that is fed through the nine-cylinder satellite printing unit 16 is not drawn off of the transfer cylinders 06, so that it does not wrap around these. This is critical for the option of using the printing unit as an imprinter.

A separate plate changing device, generally at 11, is assigned to each of the plate cylinders 07 of the four printing couples 03; 04; 21; 22. Such plate changing devices 11 are provided in order to automate and to accelerate the loading of printing plates onto each respective plate cylinder 07. The plate changing devices 11 can be configured as will be described in greater detail subsequently. Each printing couple 03; 04; 21; 22 is arranged such that both the inking unit 09 and the dampening unit 08 which are assigned to a respective one of these printing couples are positioned below an upper area of the respective plate cylinder 07. This is done in order to create space for the plate changing device 11, which is arranged above the respective inking unit 09.

The printing couples 03; 04; 21; 22 of the nine-cylinder satellite printing unit 16, and including the various corresponding inking units 09 and the corresponding dampening units 08, are arranged at least substantially symmetrically with respect to a vertical center plane M of the nine-cylinder satellite printing unit 16. The plate changing devices 11, which are assigned to the printing couples 03; 04; 21; 22, are also arranged symmetrically with respect to the vertical center plane M.

Each printing couple 03; 04; 21; 22 of the lower nine-cylinder satellite printing unit 16 has at least one drive motor which is preferably a position-controlled drive motor 12, as may be seen in FIG. 2*a*. One position-controlled drive motor 12 can be provided for each printing couple 03; 04; 21; 22; because of the narrow spatial positioning of the transfer cylinder 06 which are of small formats. The plate cylinders 07 are also expediently driven in this case by the position controlled motor 12, as is also represented in FIG. 2*a*. The plate cylinder 07 and the transfer cylinder 06 of each printing couple can be drive connected to one another, especially via gear wheels 36; 37. Each plate cylinder 07 can be positively driven, independently of the other plate cylinders 07 and/or independently of the satellite cylinder 18. The satellite cylinder 18 can preferably have its own, separate position-controlled drive motor 12. With this drive configuration, a plate change can be carried out on a plate cylinder 07 independently of the carrying out of a plate change on another plate cylinder 07.

The upper nine-cylinder satellite printing unit 17 corresponds, in its structure, to the lower nine-cylinder satellite printing unit 16. The upper nine-cylinder satellite printing unit 17 thus also includes an impression cylinder 18 which serves as satellite cylinder 18, and further includes four printing couples 28; 29; 31; 32 which are arranged adjacent to this satellite cylinder 18. For a detailed description of this upper printing unit 17, reference may be made to the preceding description of the lower nine-cylinder satellite printing unit 16. The arrangement of the printing couples 03; 04; 21; 22 and/or of the cylinders 06; 07; 18 of the lower printing unit 16 corresponds to the arrangement of the printing couples 28; 29; 31; 32 and/or of cylinders 06; 07; 18 of the other, upper printing unit 17. Additionally, the plate changing devices 11 of the one, lower printing unit 16 are arranged in the same manner as are the plate changing devices 11 of the other, upper printing unit 17.

The upper nine-cylinder satellite printing unit 17 has a frame 27. Of course, rather than the two stacked separate frames 02; 27, a single shared frame could also be provided for the two nine-cylinder satellite printing units 16; 17 or for the printing tower 14.

In the eight-couple tower 14, the web of print substrate 23 to be printed is fed at a downward slope by a guide roller 33 to a guide roller 19 and into the lower nine-cylinder satellite printing unit 16, where it is printed on one side in a four-color printing process, for example. This web 23 is then fed upward nearly vertically over another guide roller 19 and into the upper nine-cylinder satellite printing unit 17, where it is printed on the other side in a four-color printing process, for example. The web 23, which is now printed on both sides is then fed at a downward slope over a guide roller 34 to further processing stations which are not specified or depicted in greater detail here.

If the above-described printing couples 03; 04; 21; 22 of the lower printing unit 16, and the printing couples 28; 29; 31; 32 of the upper printing unit 17, which preferably operate using the offset printing method, operate using a different printing process, such as an indirect intaglio printing method, for example, the dampening units 08 are, of course, omitted.

The plate changing devices 11 are all at least substantially the same in structure, and are all arranged at least substantially horizontally, and preferably each forming an angle measuring less than 15° with the horizontal plane. In the case of the preferred embodiment of the present invention, all of the plate changing devices 11 are arranged in such a position that they always feed their respective printing plates to the corresponding plate cylinders 07 in an area at the top of the plate cylinders 07. However, in principle, they could also always feed their respective printing plates to a lower area of each one of the plate cylinders 07.

Preferably, each of the plate changing devices 11 has a plate infeed plane, which plane extends at least nearly tangentially in relation to the circumference of the plate cylinder 07 to which it is assigned.

Specifically, the plate changing devices 11 are each arranged on the respective plate cylinders 07 with which they operate in such a way that they always form an acute angle with the approaching cylinder surface of the respective plate cylinder 07. This positioning is critical to the proper functioning of the plate changing device 11, as will become clear later in this description.

Figure 2:
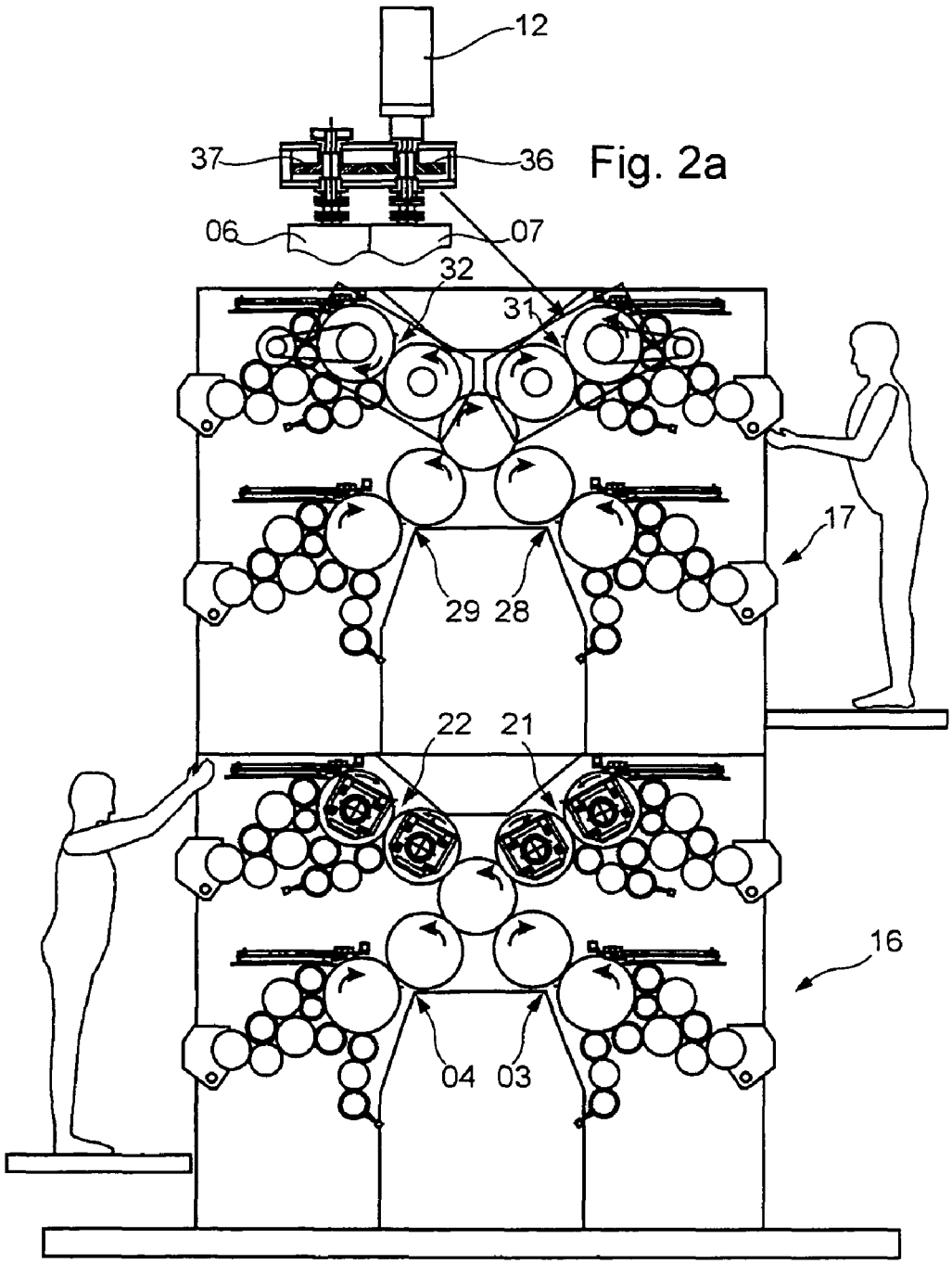
FIG. 2 the eight-couple printing tower of FIG. 1, in a phase in which the printing plates are being mounted.

The rotational directions of the cylinders 06; 07; 18 in production operation, or in other words, during printing operation, is indicated on each cylinder by an arrow, as seen in FIG. 1. The plate cylinders 07 of a nine-cylinder satellite printing unit 16 or 17 all rotate in the same direction in print operation based upon their construction. To mount a dressing 101, such as, for example, a printing plate 101, which is depicted schematically in FIG. 3, on a plate cylinder 07, the direction of rotation of the plate cylinder 07 must always be the same as the direction in which the printing plate 101 is being fed to the plate cylinder 07. In this respect, the rotational directions of the plate cylinders 07 of the printing couples 03 and 21 of printing unit 16, and of 29 and 32 of printing unit 17, as indicated in FIG. 1, coincide with the direction of rotation which will be required during plate mounting. However, this is not true of the rotational directions of the plate cylinders 07 of the other printing couples 04 of the lower unit 16, 22 and couples 28 and 31 of the upper unit 17. To solve this problem, it is provided, in accordance with the present invention that for the printing couples 04; 22; 28 and 31 the respective print image is applied to the printing plates 101 in an orientation that is rotated 180°, and that in the plate cylinders 07 of these printing couples 04; 22; 28 and 31, the direction of rotation of these plate cylinder 07 and their associated transfer cylinders 06, during mounting of the printing plates 101, is reversed, as indicated in FIG. 2. Once the appropriate printing plates 101 have been mounted, the direction of rotation of the plate cylinders 07 of the printing couples 04; 22; 28 and 31 is again reversed, so that they are again moving in the printing direction indicated in FIG. 1, but with the ends of the printing plates 101 that are usually the trailing ends now being the leading ends. This will be discussed in greater detail subsequently.

Figure 3:
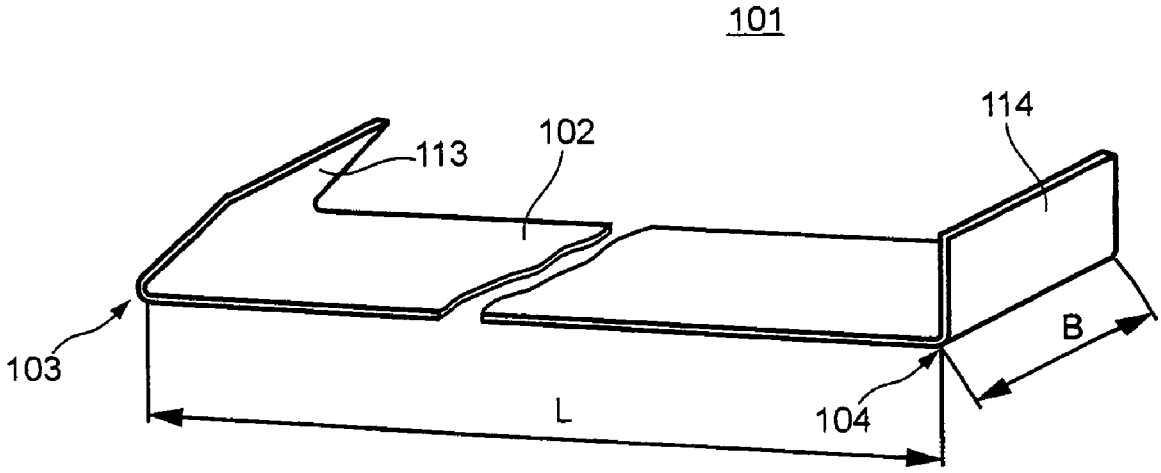
FIG. 3 a perspective view of a printing plate for use, for example, in conjunction with the plate cylinders of the printing tower of FIG. 1.

FIG. 3 shows a preferred embodiment of a plate-type printing plate 101, which may be made of flexible metal. Plate 101 can have a length L of between 400 mm and 1,300 mm and a width B of between 280 mm and 1,500 mm, for example. When mounted, the printing plate 101 rests with a contact surface 102 on the circumferential surface of a plate cylinder 07. The printing plate 101 has two opposite ends 103; 104 with angled suspension legs 113; 114. The leading suspension leg 113 of a first, leading end 103 is angled at an acute angle, for example, and the trailing suspension leg 114 of a second, trailing end 104 is angled at a right angle, for example.

At the leading end 103, the leading end suspension leg 113 is preferably acutely angled, and is especially angled at an opening angle of from 35° to 55°. At the trailing end 104, the trailing end suspension leg 114 is preferably angled at an opening angle of from 80° to 100°.

Figure 4:
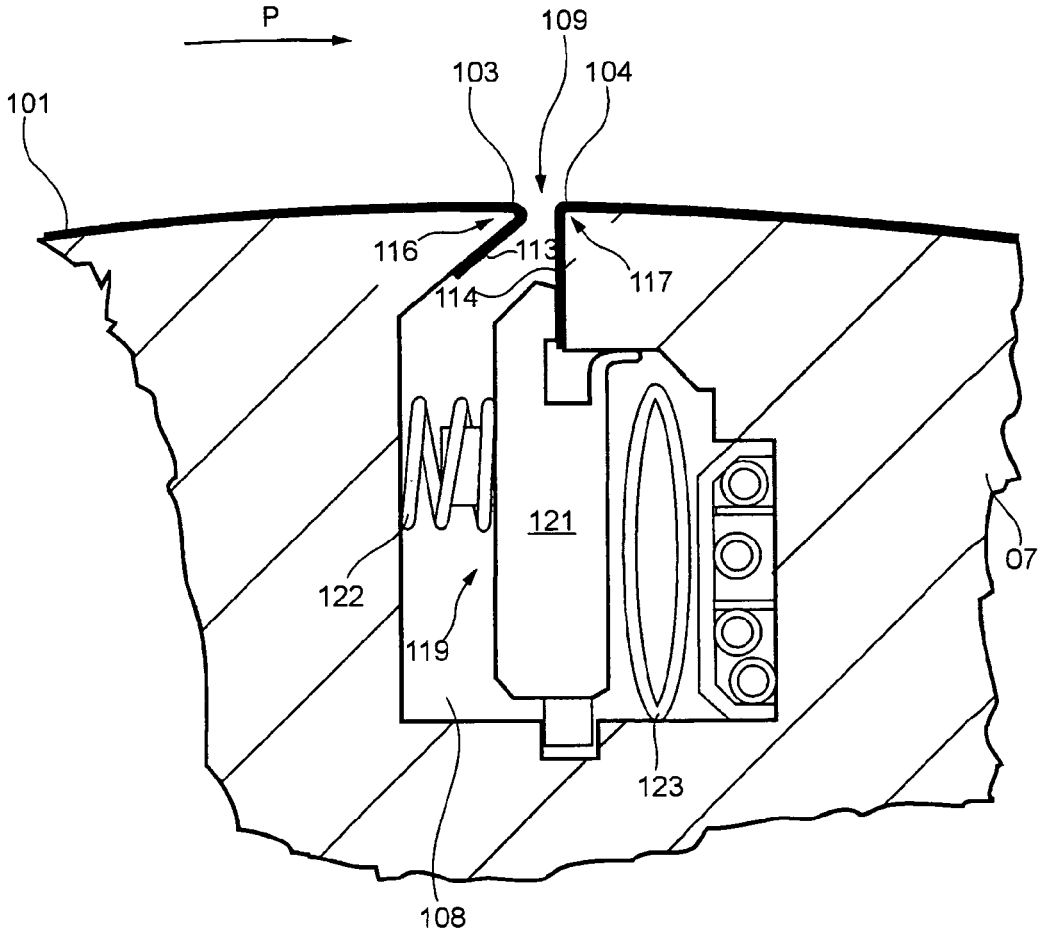
FIG. 4 a schematic cross-section of a holding device for a printing plate that is mounted on a plate cylinder, such as, for example, a plate cylinder of the printing tower of FIG. 1.

As is shown in FIG. 4, the suspension legs 113; 114 of the printing plate 101 are fastened by the use of a holding device 119. Such a holding device 119 is typically arranged in a groove 108, such as, for example, a cylinder groove 108, which groove 108 extends within the plate cylinder 07, and is oriented generally axially in relation to the plate cylinder 07. The end 103 of the printing plate 101 that is usually oriented in the same direction as the production direction P of the plate cylinder 07 is called its leading or first end 103, while the opposite end 104 is called the trailing or second end 104 of the printing plate 101.

The suspension legs 113; 114 can each be inserted into a narrow, and particularly into a slit-shaped opening 109 in the groove 108 of the cylinder 07. Once so inserted, the suspension legs 113; 114 can be fastened in the opening 109 by the use of the holding device 119, which may be configured as, for example, a clamping device.

The acutely angled suspension leg 113, which is situated at the leading end 103 of the printing plate 101, can be suspended in a positive connection at a front edge 116, such as, for example, a suspension edge 116, of the opening 109. The suspension leg 114, which is angled at a right angle, and which is situated on the trailing end 104 of the printing plate 101, can be suspended in a positive connection at a rear edge 117 of the opening 109.

At least one pivotably mounted holding member 121 and one prestressed spring element 122 are arranged in the groove 108, for example. The spring element 122 presses the holding member 121 against the angled suspension leg 114 on the trailing plate end 104, for example, which angled suspension leg 114 is suspended from the rear edge 117 of the opening 109. This suspension leg 114 on the trailing plate end 104 is held in place against the wall which extends from the rear edge 117 to the groove 108. To release the pressure force that is exerted by the holding member 121, an actuating element 123, which preferably is a pneumatically actuable actuating element 123, is provided in the groove 108, which actuating element 123, when it is actuated, pivots the holding member 121 against the force of the spring element 122, thereby releasing the suspension leg 114. The holding device 119, which has been described by way of example, therefore comprises substantially the holding member 121, the spring element 122 and the actuating element 123.

In the case of the printing tower 14, which is represented in FIG. 1, the orientation of the assembly shown in FIG. 4 relates to the plate cylinders 07 of the printing couples 03; 21; 29 and 32, whereas the orientation of the printing couples 04; 22; 28 and 31 is a mirror image. In other words, the mirror-image embodiment of the nine-cylinder satellite printing unit 16 or 17 mentioned further above, or the printing tower 14 that is formed in this manner, is formed around a vertical center plane M, with this mirror image including the configuration of the grooves 108 in the respective plate cylinders 07.

Figure 6:
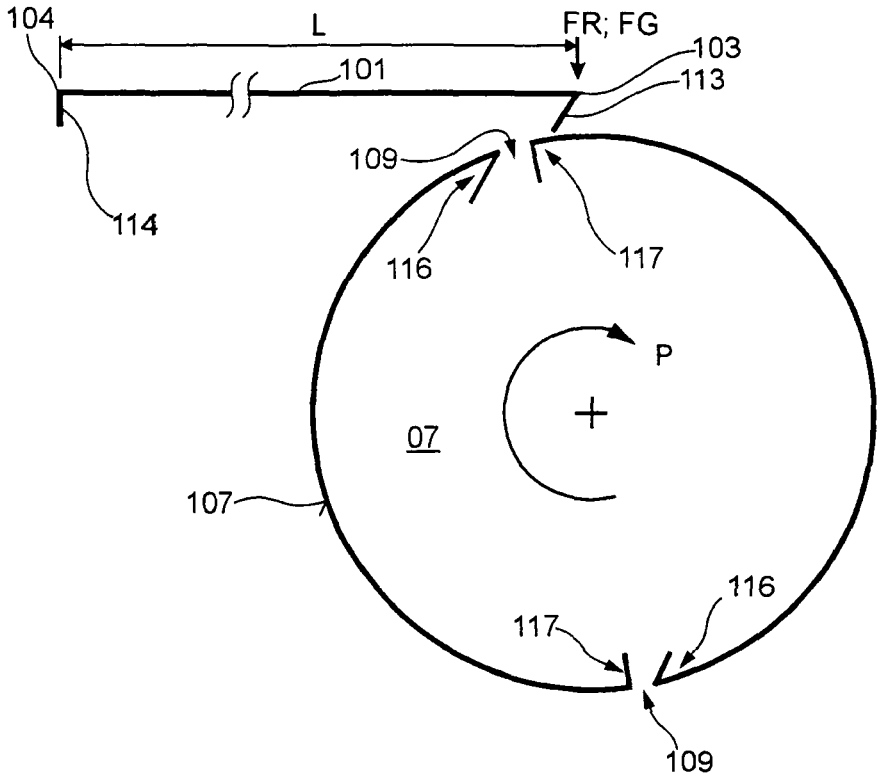
FIG. 6 a schematic representation of the mounting of printing plates on a plate cylinder, such as, for example, a plate cylinder of the printing tower of FIG. 1.

In the discussion which now follows, a method for mounting a printing plate 101 on a plate cylinder 07 of the printing press will be described in reference to FIGS. 6 and 7. In the case of this preferred embodiment, two printing plates 101 can be arranged one in front of another about the circumference of the plate cylinder 07, and accordingly, two grooves 108, which are arranged diametrically opposite one another, are provided in the plate cylinder 07. A leading end 103 of the printing plate 101 is fed to the cylinder 07, preferably tangentially, and moving in the cylinder's direction of production P, for example by the imposition of a pushing force acting on the plate trailing end 104, until the suspension leg 113 at the leading plate end 103 is located behind the second edge 117 of the opening 109 on the plate cylinder 07. As the plate cylinder 07 now rotates in its direction of production P, the suspension leg 113, which has been previously formed on the leading plate end 103, engages in the opening 109 and becomes hooked on the first edge 116 as a result of a radial force FR which is acting at least on the plate leading end 103 and which is directed toward the plate cylinder 07. If the suspension leg 113, which is formed on the leading end 103 of the printing plate 101, rests supported against the circumferential surface 107 of the plate cylinder 07, the radial force FR can be the gravitational force FG of the printing plate 101 acting on the circumferential surface 107 of the plate cylinder 07, for example.

Figure 7:
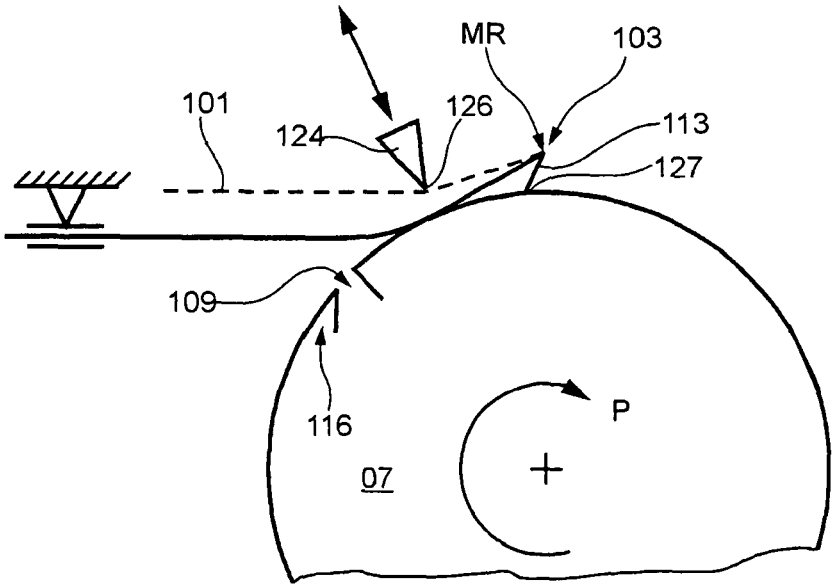
FIG. 7 a further schematic representation of the mounting of a printing plate on a plate cylinder, such as, for example, a plate cylinder of the printing tower of FIG. 1.

In addition to utilizing the gravitational force FG of the printing plate 101, or as a possible alternative to this, the plate leading end 103 can be elastically prestressed, as depicted in FIG. 7, so that the suspension leg 113 formed on the plate leading end 103 springs into the opening 109 as a result of a restoring force MR which is directed toward the plate cylinder 07. This movement of the plate end will occur once the opening 109 in the plate cylinder 07 and the line of contact 127 between the suspension leg 113 and the circumferential surface 107 of the plate cylinder 07 are positioned directly opposite one another, as a result of a relative movement between the printing plate 101 and the plate cylinder 07. Such a relative movement is typically generated especially by the rotation of the plate cylinder 07 in the production direction P.

The restoring force MR therefore results from the fact that the printing plate 101 is made of an elastically deformable material and thus inherently possesses an elastically resilient property. The elastically resilient property is utilized in such a way that, in the course of its being fed to the plate cylinder 07, the plate leading end 103 is guided, for example, over an edge 126 of a support element 124 which preferably extends axially in relation to the plate cylinder 07 and which is arranged spaced from the plate cylinder 07. The plate is angled such that on the plate leading end 103, a bending stress builds up with a spring force which is directed toward the plate cylinder 07, as may be seen in the dashed representation of a printing plate 101 in FIG. 7. The support element 124 can be embodied as a roller element 124, for example, and especially can be embodied as a roller 124, or can be embodied as one or more rollers 124 which may be arranged side by side axially in relation to the plate cylinder 07, which rollers 124 can be engaged against the plate cylinder 07, for example to function as a contact pressure element 124.

As the dressing 101 or the printing plate 101 is drawn further onto the plate cylinder 07, the suspension leg 113 on the plate leading end 103 of the dressing 101 hooks onto the first edge 116 of the opening 109. In this process, a roller element 124, which may be engaged against the plate cylinder 07, can assist in, or facilitate the mounting of the dressing 101 on the plate cylinder, in that the roller element 124 rolls the dressing 101 onto the plate cylinder 07. At the trailing end 104 of the dressing 101, the suspension leg 114 is so formed, as has been discussed above, wherein this trailing suspension leg 114 is forced, by the roller element 124, into the opening 109 in the cylinder 07 as the dressing 101 is being rolled onto the plate cylinder 07.

Figure 8:
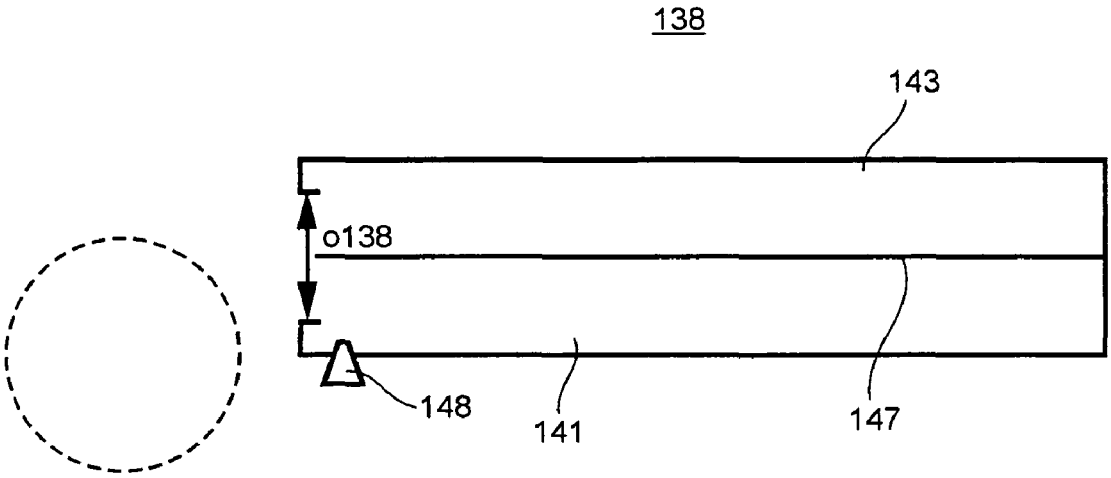
FIG. 8 a schematic side view of a printing forme magazine, for example, for use in connection with a printing tower of FIG. 1.

To change one or more printing plates 101 that are arranged on the respective plate cylinders 07, a plurality of printing forme magazines 138 are provided, as are represented schematically in FIG. 8. Each printing forme magazine 138 is provided for cooperation with a plate changing device 11 that feeds in and removes plates from above. The printing forme magazine 138 has a receiving device 141, for example a lower chute 141, for use in receiving at least one used printing plate 101 which is to be removed from the respective plate cylinder 07, and a receiving device 143, for example an upper chute 143, for receiving a new printing plate 101 which is to be mounted on the respective plate cylinder 07. The plate receiving devices or chutes 141; 143 each preferably has a plurality of storage positions for used printing plates 101 to be removed and for new printing plates 101 to be mounted.

In the printing forme magazine 138, the chutes 141; 143 are arranged at least substantially parallel to one another. As seen in FIG. 8, they are preferably arranged one above another in a layered construction. In this arrangement, for example, a dividing panel 147 can separate the chutes 141; 143 from one another in the printing forme magazine 138. Each chute 141; 143 preferably has at least two storage positions for the printing plates 101 to be stored in it.

The printing forme magazine 138 preferably extends over the length of the body of the plate cylinder 07 with which it is associated. It extends at least over the width B of the printing plate 101, and is preferably capable of fully accommodating one printing plate 101, in other words, over the plate's entire length L, in its chutes 141; 143. In each case, one printing plate 101 can be fed through an opening o138 to the plate cylinder 07 or can be introduced from that plate cylinder 07 into the chute 141 through the opening o138.

In the printing forme magazine 138, for use with a plate changing device 11 which is embodied for supplying and for removing plates from above the plate cylinder 07, the chute 143 for the new printing plates 101 to be mounted is positioned above in the magazine 138, and the chute 141 which is used for receipt of the used printing plates 101 is positioned below chute 143.

Figure 9:
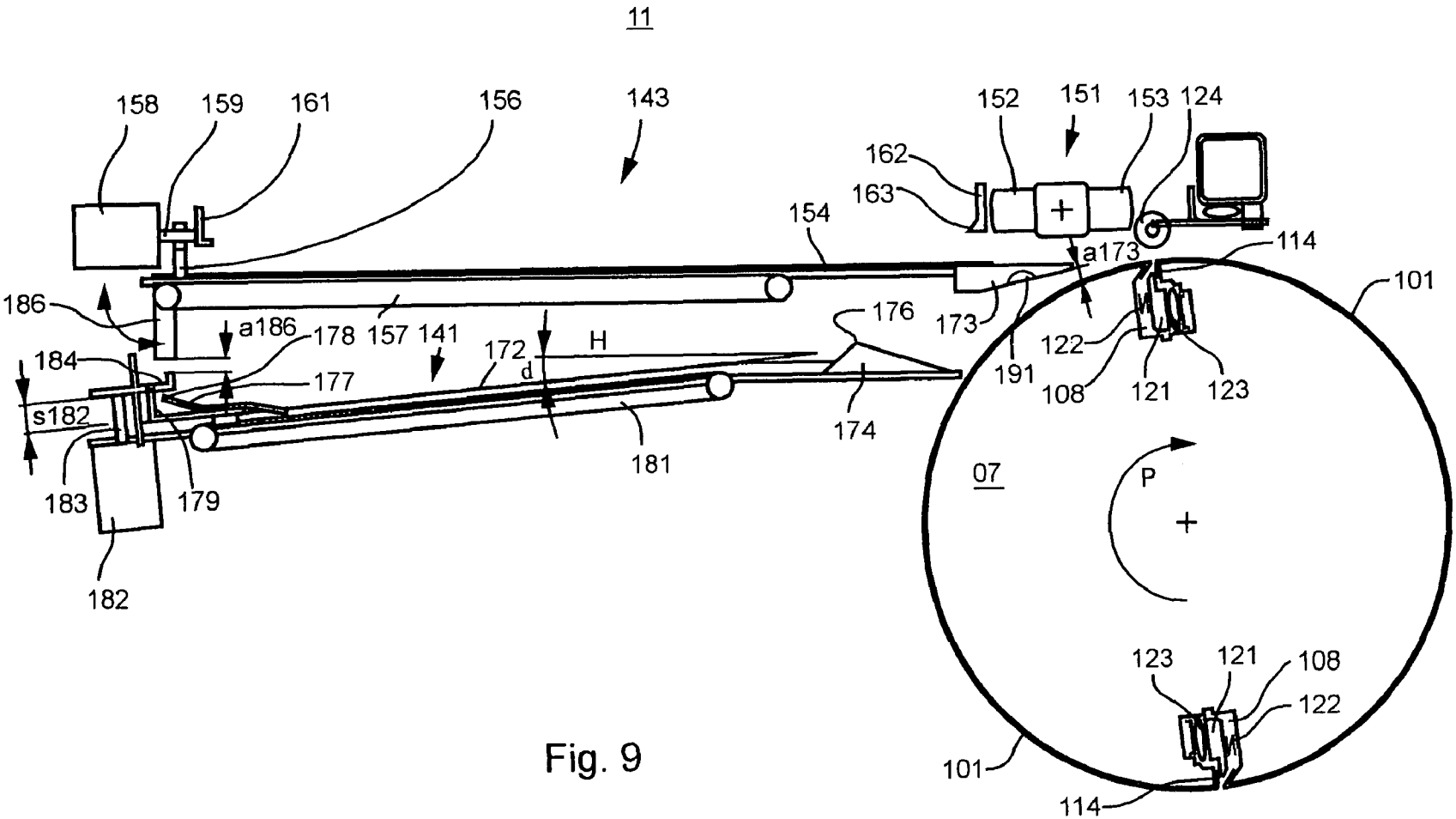
FIG. 9 a side view of an embodiment of a plate changing device for use, for example, in a printing tower of FIG. 1.

Each printing forme magazine 138 can be movably mounted. The movable arrangement of each printing forme magazine 138 provides improved access to the respective printing couple 03; 04; 21; 22; 28; 29; 31; 32, which improved access is important, for example, for performing work that may be necessary there, such as maintenance work. In the operating position, preferably the chutes 141; 143 of the printing forme magazine 138, but at least the storage positions for the printing plates 101 in the chutes 141; 143, are aligned horizontally or at a slight inclination, if possible with an opening angle δ, as seen in FIG. 9 of less than 25°, and preferably with an opening angle δ of less than 15° from the horizontal plane H. The opening o138 of the printing forme magazine 138 advantageously points toward one of the openings 109 in the plate cylinder 07 with which the printing forme magazine 138 cooperates.

The reference symbol 148, which is shown in FIG. 8 schematically, identifies a stop mechanism, such as, for example, a bolt 148, which is configured to hold a movably mounted printing forme magazine 138 in its operating position in front of the respective plate cylinder 07. When the printing forme magazine 138 is in its operating position, at least one printing plate 101 can be exchanged between the chutes 141; 143 and the plate cylinder 07. Either a printing plate 101 that is no longer needed to perform a print job is removed from the plate cylinder 07 and is fed into the chute 141, or a new printing plate 101, for use in performing a print job, is removed from the chute 143 and is mounted on the plate cylinder 07.

The basic structure, as well as additional details of a preferred embodiment of a plate changing device 11 will now be described with reference to FIG. 9 through 14. This will be accomplished in connection with the structure and the functioning of an example of a plate changing device 11 that supplies and removes plates from the top, for example in connection with the printing couple 32. In this connection, reference is made to WO 2004/085160 A1 and to its content which describes a corresponding plate changing device 11 within the context of several preferred embodiments. The disclosures of WO 2004/085160 A1 are incorporated herein by reference.

FIG. 9 shows a plate cylinder 07 with two grooves 108 on its circumference, and which two grooves 108 are offset from one another by 180°, FIG. 9 further shows two printing plates 101 which are arranged one behind another along the circumference of the plate cylinder 108. FIG. 9 also further shows a contact pressure element 124 in the form of a pressure cylinder 124 or pressure roller 124 that can be engaged against the plate cylinder 07 by pneumatic actuation. Also provided near the plate cylinder 07 is an alignment device 151 which is mounted so as to be pivotable about an axis which is parallel to the axial direction of the cylinder, and which is configured with two diametrically arranged, wing-like stops 152; 153 which act laterally on a printing plate 101. The alignment device 151 uses one of its stops 152; 153 to temporarily fix a printing plate 101 that is to be mounted on the plate cylinder 107, as it is being moved toward the plate cylinder 07, thereby keeping it true to lateral register.

In the chute 143 there is provided a support surface 154, on which a first printing plate 101 to be mounted on the plate cylinder 07 can be set or placed and resting on its bent suspension legs 113; 114. A printing plate 101 that has been placed on the support surface 154 rests there, for example, over its entire extended length L, as may be seen in FIG. 10.

The suspension leg 114 at the trailing end 104 of the first printing plate 101 lies in the chute 143 on the side of the chute which is facing away from the plate cylinder 07 on a preferably vertical stop 156, which is identified in FIG. 9. The stop 156 can be moved by a conveyor device 157 linearly and in a direction parallel to the support surface 154 in the direction of the opening o138 in the printing forme magazine 138. This movement is provided in order to convey this first printing plate 101, via a translational movement and preferably without deformation, out of the chute 143, at least up to the point at which the suspension leg 113 at the leading end 103 of this first printing plate 101 is able to be received in the slit-shaped opening 109 in the printing cylinder 07. The stop 156 therefore serves as the locating position for the first printing plate 101 in the chute 143. At the same time, it performs the function of a pushing element 156. If this first printing plate 101 also has at least one register stamp on the suspension leg 114, at its trailing end 104, the stop 156 can advantageously also be configured, for example, as a register pin 156 that is perpendicular to the support surface 154 and which is connected to the conveyor device 157. The result is that when the first printing plate 101 is placed against the stop 156, it is also pre-registered by the register pin 156 with respect to its lateral register. The conveyor device 157 for the stop 156 is embodied, for example, as a belt drive 157 or as a linear drive 157, preferably as a pneumatic linear drive 157, especially as a double-sided linear drive 157 without a piston rod.

Figure 10:
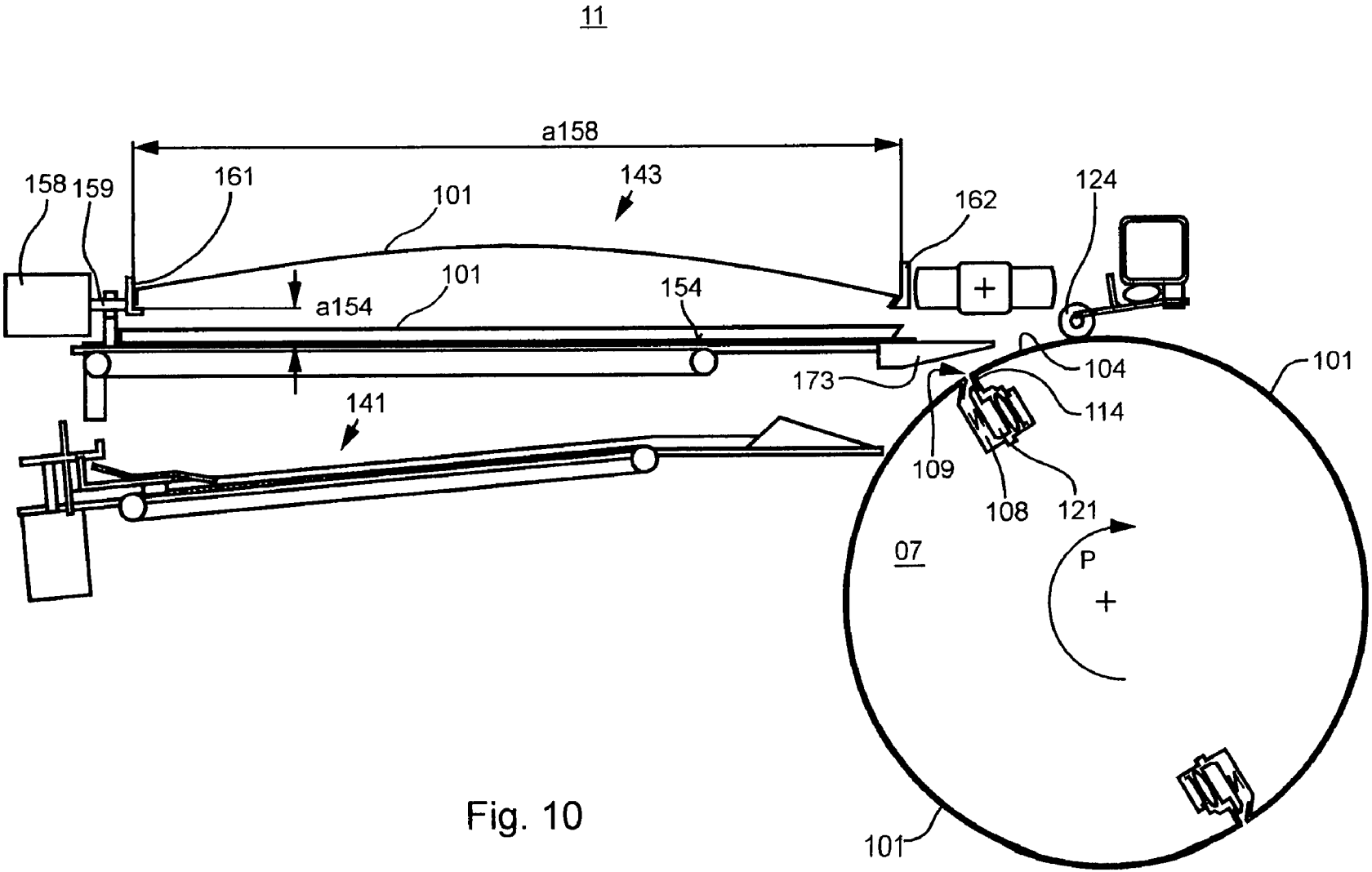
FIG. 10 the plate changing device of FIG. 9 with another printing plate to be supplied.

In the chute 143 a holder 158 is located, this holder is preferably a printing forme holder 158 for use in holding at least a second printing plate 101 which is also to be mounted on the plate cylinder 07. As is represented in FIG. 10, the second printing plate 101 is held by the printing forme holder 158 above the support surface 154, for example. The printing forme holder 158 preferably has a piston 159 or a pushing element 159 that can be moved parallel to the support surface 154, for example on the side that faces away from the plate cylinder 07. A holding element 161, such as, for example, an L-shaped bracket 161, is arranged at the end of piston 159. The second printing plate 101 is clamped above the support surface 154 between the bracket 161 of the extended pushing element 159 and another holding element 162, which may be, for example, a rigidly mounted stop 162, that is arranged in the area of the opening o138 of the printing forme magazine 138. In this connection, a distance a154 has a value which preferably ranges from two to four times the length of the suspension leg 114 at the trailing end 104 of the second printing plate 101.

The second printing plate 101 is clamped by virtue of the fact that an inside distance a158 between the bracket 161 of the extended pushing element 159 and the stop 162 is adjusted to be shorter than the extended length L of the second printing plate 101.

The stop 162 in the area of the opening o138 in the printing forme magazine 138 preferably has a beveled edge 163, as depicted in FIG. 9 and on which the suspension leg 113 at the leading end 103 of the second printing plate 101 can be supported. The beveled edge 163 of the stop 162 and the L-shaped bracket 161, against which the suspension leg 114 at the trailing end 104 of the second printing plate 101 is supported, face one another. Because the second printing plate 101 is flexible, especially along its length L, it curves when it is clamped between the bracket 161 and the stop 162. The pushing element 159 of the printing forme holder 158 is preferably movable linearly parallel to the support surface 154 and preferably has two stable operating positions. A first stable operating position is in its retracted position, in which the second printing plate 101 is released, and a second stable operating position is in its extended position, in which the second printing plate 101 is clamped.

In FIG. 9, another, second chute 141 is represented, which second chute 141 is used to hold printing plates 101 that have been removed from the plate cylinder 07. This second chute 141 has an inclined support surface 172, for example, which, like the support surface 154 in the first chute 143, is configured to hold printing plates 101 ready to be mounted on the plate cylinder 07 support surface 172 is intended to support plates 101 preferably not over their entire surface. It is configured in the form of parallel strips 172 or sliding rails 172. In the example shown in FIG. 9, the chute 141 for receiving printing plates 101 that have been removed from the plate cylinder 07 is positioned below the chute 143 for holding printing plates 101 that are to be mounted on the plate cylinder 07, which is a preferred, but not an obligatory arrangement.

One preferred embodiment of the second chute 141 provides that at least two printing plates 101 can be stored in the chute 141, side by side in the axial direction of the printing cylinder 07. This embodiment enables a particularly rapid removal of printing plates 101, especially if at least two printing plates 101 can be arranged on the plate cylinder 07 in its axial direction. This rapid removal is possible because a plurality of printing plates 101 can be removed from the plate cylinder 07 at the same time.

On the side of the second chute 141 that faces the plate cylinder 07, the chute 141 for holding printing plates 101 that have been removed from the plate cylinder 07 has a guide element 173, which is arranged near the circumferential surface 107 of the printing cylinder 07, at least in the operating position of the plate storage device in which the chute is engaged against the plate cylinder 07. The guide element 173 is preferably embodied, for example, in the form of a deflector plate 173, a wedge 173 or a roller element 173, such as, for example, a roller 173, and has the task of guiding the trailing end 104 of a printing plate 101, which is to be removed from the plate cylinder 07, into the chute 141. A distance a173 of the guide element 173 from the circumferential surface 107 of the printing cylinder 07 is preferably not much greater than the length of the angled suspension leg 114 at the trailing end 104 of the printing plate 101. On the guide element 173, a sensor 191 can be attached, which sensor 191 senses, either by being in contact with the printing plate 101 to be removed from the plate cylinder 07 or advantageously in a contactless fashion, such as, for example, inductively, whether the suspension leg 114 at the trailing end 104 of the printing plate 101 to be removed from the plate cylinder 07 has actually been released following an actuation of the holding assembly 121 that is arranged in the groove 108 of the printing cylinder 07.

In a preferred embodiment of the present invention, once the suspension leg 114 at the trailing end 104 of the printing plate 101 to be removed from the plate cylinder 07 passes the guide element 173, but before it reaches the support surface 172 in the chute 141, it preferably comes to rest on a first ramp 174 which, as may be seen in FIG. 9, is arranged spaced from the guide element 173. In the direction of the support surface 172, and away from the printing cylinder 07 the first ramp 174 is first inclined upward. After reaching a peak 176, ramp 174 drops back down to the support surface 172. The first ramp 174 is preferably rigidly connected to the support surface 172. As the printing plate 101, which is to be removed from the plate cylinder 07, continues to be introduced or inserted into the chute 141, the suspension leg 114 at its trailing end 104 strikes a second ramp 177. This second ramp 177 also inclines upwardly to a peak 178 and with the side of that ramp beyond its peak 178, i.e., on the side that faces away from the plate cylinder 07, preferably dropping steeply down to the support surface 172. In the direction of travel, in which the printing plate 101 is introduced into the chute 141, a stop 179 that is rigidly connected to the second ramp 177 is arranged a short distance behind the peak point 178 of the second ramp 177. The suspension leg 114 on the trailing end 104 of the printing plate 101 strikes stop 179. When the suspension leg 114 on the trailing end 104 of the printing plate 101 strikes the stop 179, it preferably engages behind the second ramp 177. The suspension leg 114 is thus in the intermediate space formed by the spacing of the stop 179 from the peak point 178 of the second ramp 177.

The second ramp 177 and the stop 179, which is attached to it, can be moved linearly and parallel to the support surface 172 by the use of a conveyor device 181. This movement can be accomplished in order to convey the printing plate 101 to be removed from the plate cylinder 07 completely into the chute 141. The conveyor device 181, especially when combined with the steep side of the second ramp 177 for the angled suspension leg 114 on the trailing end 104 of the printing plate 101, forms a carrier device for use in conveying the printing plate 101 into the chute 141. The conveyor device 181 is embodied, for example, as a belt drive 181 or as a linear drive 181, and preferably is embodied as a pneumatic linear drive 181, and especially as a double-sided linear drive 181 without a piston rod.

A lifter 182, which is especially configured as a printing forme lifter 182, is arranged in the chute 141 on the side of chute 141 that faces away from the plate cylinder 07. The printing forme lifter 182 has a piston 183, for example, which can preferably be moved perpendicular to the support surface 172. Piston 183 may be provided, for example, with a lifting arm 184, which lifting arm 184 is embodied as an L-shaped arm, or especially as a U-shaped lifting arm, for example, and being arranged at the end of the piston. The angled suspension leg 114 at the trailing end 104 of the printing plate 101 is placed on, or is set around the lifting arm 184. The printing forme lifter 182 preferably has two stable operating positions. It has a first stable operating position in which the piston 183 is retracted, and in which the lifting arm 184 is situated below the level defined by the support surface 172. It further has another stable operating position in which the piston 183 is extended, and further in which the lifting arm 184 raises the printing plate 101 that has been removed from the plate cylinder 07 off of the support surface 172. In this process, the printing forme lifter 182 executes a lifting stroke s182, which is greater than the length of the angled suspension leg 114 at the trailing end 104 of the printing plate 101. Preferably, the lifting stroke s182 has a value of between one and two times the length of the suspension leg 114. The printing forme lifter 182 thus raises a printing plate 101 that has been removed from the plate cylinder 07 from a preliminary first storage position to a final, elevated second storage position.

A securing element 186, such as, for example, an element in the form of a strip-shaped flap 186, which is preferably capable of pivoting around a pivoting axis that extends substantially parallel to the width B of the printing plate 101, is arranged above the printing forme lifter 182, especially above its lifting arm 184. A lower edge of the securing element 186 is spaced a distance a186 from the lifting arm 184. The spacing distance a186 is preferably shorter than the length of the angled suspension leg 114 at the trailing end 104 of the printing plate 101. In FIG. 9, a directional arrow indicates the pivoting capability of the securing element 186. The securing element 186, in use, secures a printing plate 101 that has been raised by the printing forme lifter 182 from unintentionally sliding in the chute 141 or coming out of the chute 141. A press operator must first pivot the securing element 186, before the raised printing plate 101 can be removed from the chute 141.

FIG. 10 through 14 show, by way of example, several stages of the process sequence for changing printing plates 101 on a plate cylinder 07. It is assumed that two printing plates 101 are initially arranged in the upper chute 143, which upper chute 143 holds new printing plates 101 ready for mounting on the plate cylinder 07. Two printing plates 101 are assumed to be mounted on the plate cylinder 07 along its circumference. The lower chute 141, which holds printing plates 101 that have been removed from the plate cylinder 07, is presumed to initially be empty, i.e., without printing plates 101, as depicted, for example, in FIG. 10. The plate cylinder 07 initially rotates and moves the opening 109 of a groove 108, in which the suspension leg 114 at the trailing end 104 of the printing plate 101 to be removed from the plate cylinder 07 is held by a holding assembly 121, into a first position. In this first position, the groove 108 is located below the guide element 173 that belongs to the lower chute 141, as seen in FIG. 10. The contact pressure element 124 is engaged against the plate cylinder 07, as may also be seen in FIG. 10.

The holding assembly 121 is then pivoted against the force of a spring element 122, thus allowing the suspension leg 114 at the trailing end 104 of the printing plate 101 to snap out of the opening 109 and to strike against the guide element 173. This movement is a result of the inherent elastic tension of the printing plate 101. The contact pressure element 124, which is engaged against the surface of the printing plate 101, secures the printing plate 101 against further separation from the circumferential surface 107 of the plate cylinder 07.

The plate cylinder 07 then rotates counter to its direction of production P, thereby pushing the trailing end 104 of the printing plate 101 into the chute 141. As the trailing end 104 of the printing plate 101 is being introduced into the chute 141, the rear suspension leg 114 at the trailing end 104 of this printing plate 101 first slides along the guide element 173 and then comes to rest on the first ramp 174, which belongs to the chute 141. The rear suspension leg 114 slides upwardly along the ramp 174 and up to the ramp's peak point 176. Rear suspension leg 114 finally comes to rest on the support surface 172. While the contact pressure element 124 continues to be engaged against the plate cylinder 07, the printing plate 101 continues to be pushed further into the chute 141 by virtue of the rotation of the plate cylinder 07 counter to its direction of production P. In this process, the suspension leg 114, at its trailing end 104, continues to move into the chute 141 and also overtakes or engages the second ramp 177, which is connected to the conveyor device 181, and strikes against the stop 179 that is connected to the second ramp 177.

Figure 11:
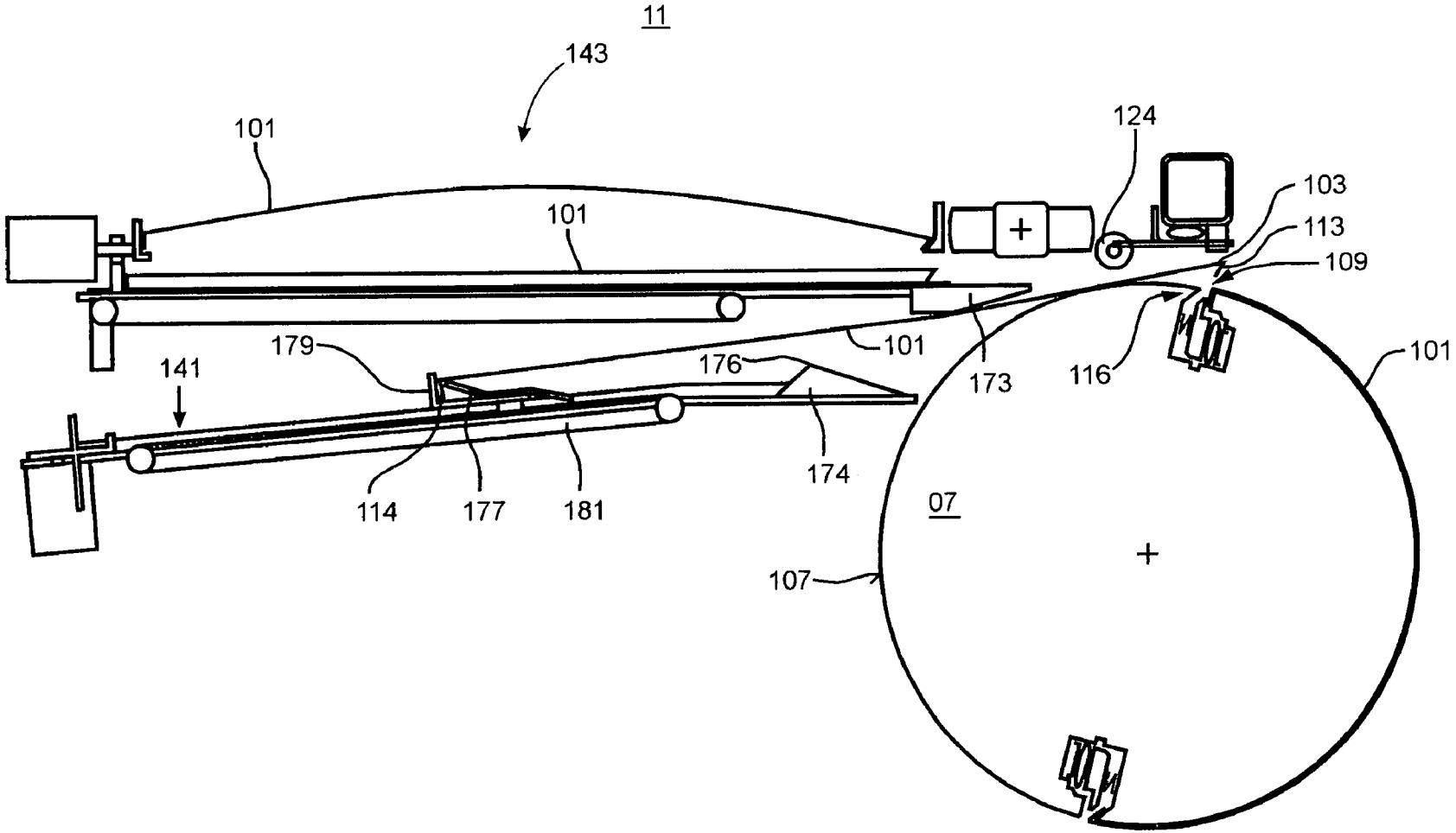
FIG. 11 the plate changing device of FIG. 9 or 10 with the plate change being depicted in a first operating stage.
Figure 12:
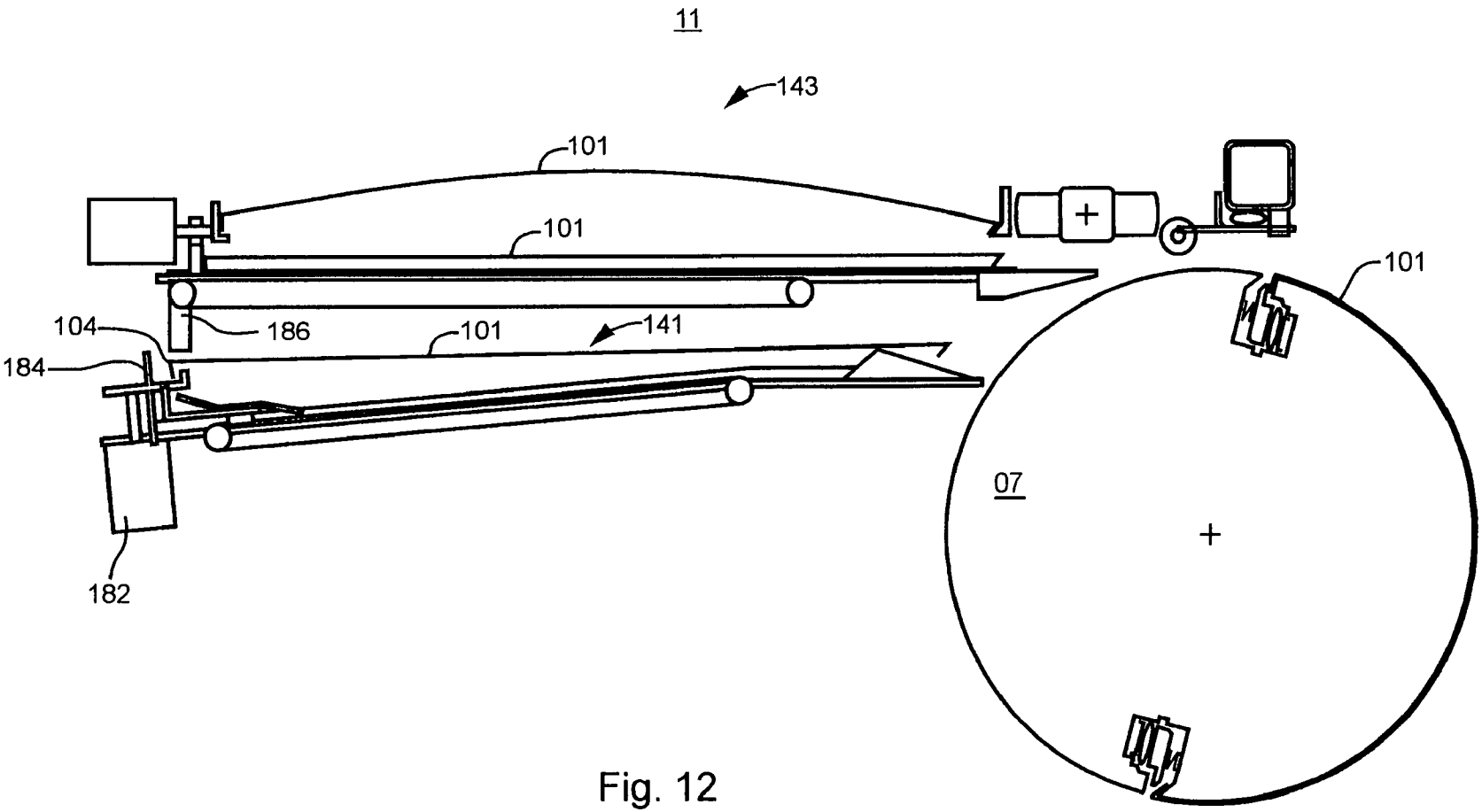
FIG. 12 the plate changing device of FIG. 9 or 10 with the plate change depicted in another operating stage.

The contact pressure element 124 is then disengaged from the plate cylinder 07. The impact of the rear suspension leg 114 at the plate trailing end 104 against the stop 179 causes the angled suspension leg 113 at the leading end 103 of the printing plate 101, which is suspended in a positive connection from the front edge 116 of the opening 109, to be released from the opening 109. The leading edge 103 of the printing plate 101 then rests, unattached, on the circumferential surface 107 of the printing cylinder 07. From the point of release of the rear suspension leg 114 at the trailing end 104 to this point of release of the front suspension leg 103, the plate cylinder 07 has executed less than one half of a rotation. The angled suspension leg 114 at the trailing end 104 has now become hooked between the second ramp 177 and the stop 179. The conveyor device 181, which is connected to the second ramp 177 and to the stop 179, can now draw the printing plate 101 all the way into the chute 141. This procedure is depicted in FIG. 11.

The old, used printing plate 101 has now been removed from the plate cylinder 07 and is situated lengthwise L in the chute 141. The suspension leg 114 at its trailing end 104 rests on the peak point 178 of the second ramp 177, while its leading end 103 rests on the peak point 176 of the first ramp 174. At least the suspension leg 113 at the leading plate end 103 preferably hangs unattached. The printing plate 101 is therefore preferably held in the chute 141 supported at two points, namely at the peak points 176; 178 of the two ramps 174; 177.

The printing forme lifter 182, which is pneumatically actuable, for example, then raises the rear portion of the printing plate 101, which has been drawn into the chute 141, at its trailing end 104 up to slightly below the securing element 186. In this position, the rear suspension leg 114 rests on the lifting arm 184 that is connected to the printing forme lifter 182, as may be seen, for example, in FIG. 12.

Figure 13:
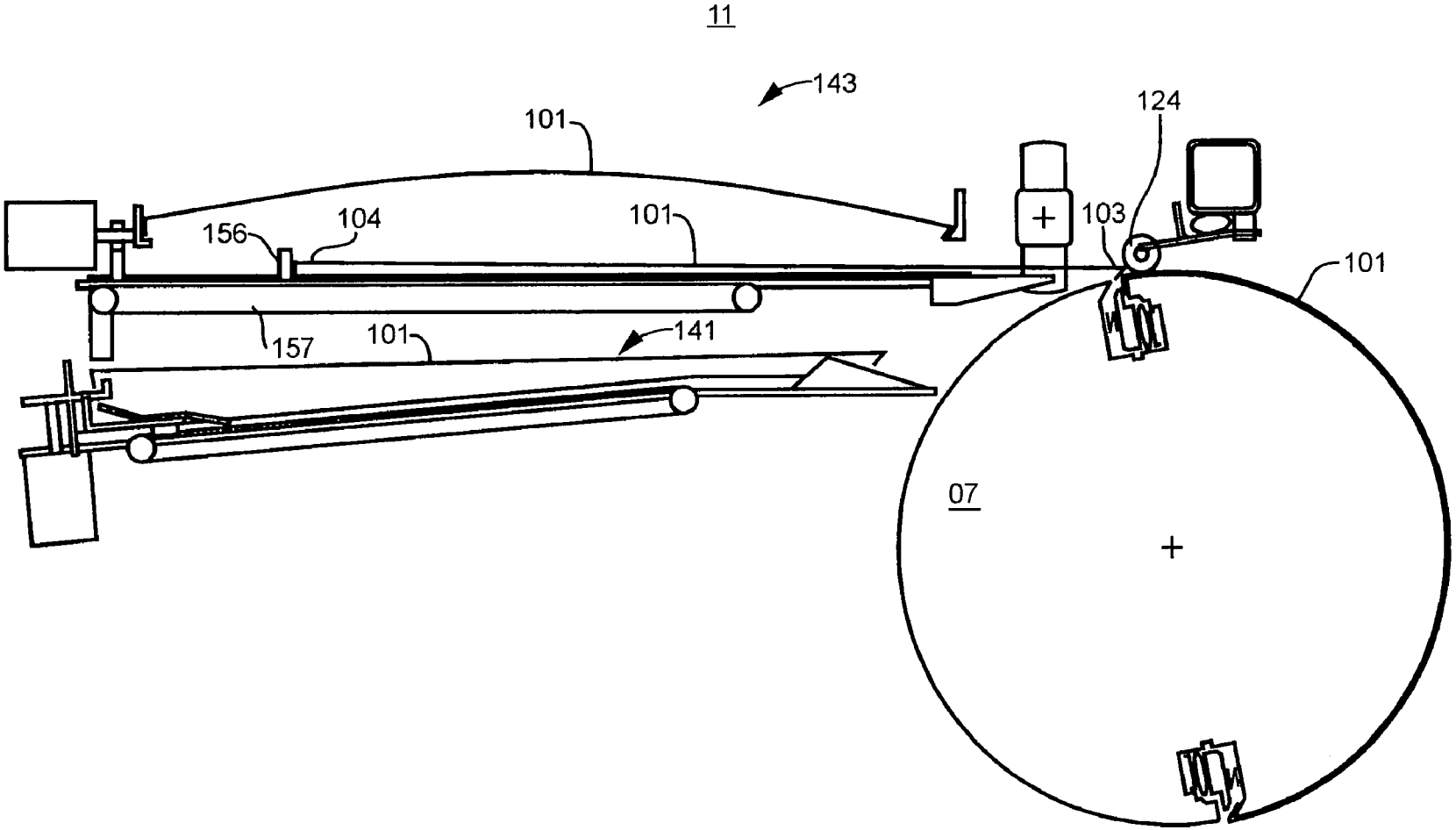
FIG. 13 the plate changing device of FIG. 9 or 10 with the plate change being depicted in another operating stage.
Figure 14:
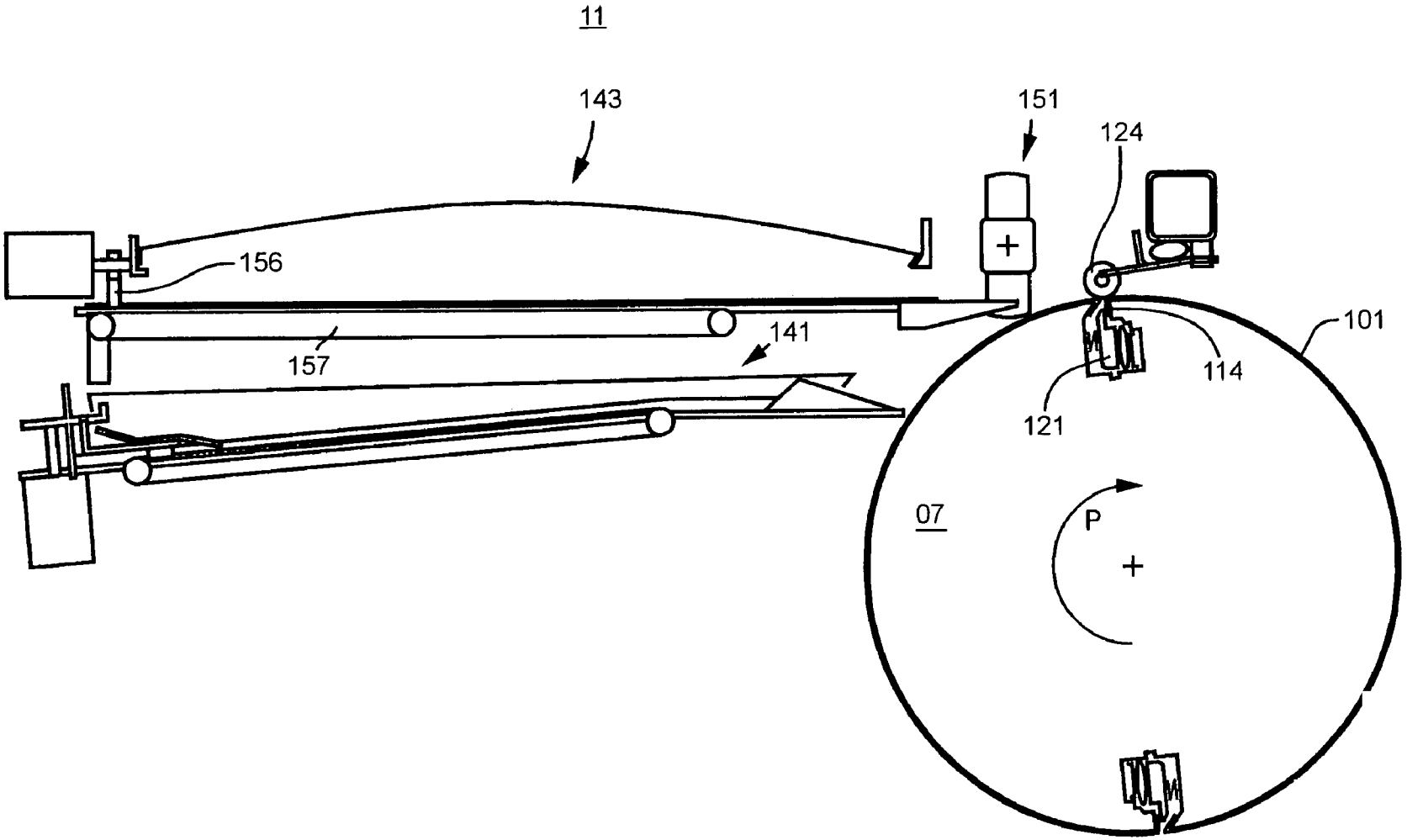
FIG. 14 the plate changing device of FIG. 9 or 10 with the plate change being depicted in yet another operating stage.

The alignment device 151, which is arranged close to the plate cylinder 07, preferably now pivots its diametrically opposing stops 152; 153, which had preferably previously been aligned horizontally, through 90° and to a vertical position, as seen in FIG. 13. A stop 152; 153, which is adjusted to accommodate the width B of the printing plate 101 to be mounted on the plate cylinder 07, dips into a transport plane defined by the support surface 154 in the chute 143 for the printing plate 101 to be mounted on the plate cylinder 07. The new printing plate 101, which is to be mounted on the plate cylinder 07, is aligned with the stop 152; 153 relative to the plate cylinder 07 so as to be laterally true to register, as this new printing plate 101 is transported out of the chute 143.

To mount a printing plate 101, which is to be mounted on the plate cylinder 07, that plate cylinder 107 first continues to rotate counter to its production direction P into a receiving position. The first printing plate 101 to be mounted on the plate cylinder 07 is situated with the suspension leg 114 at its trailing end 104 situated at the stop 156 that is connected to a conveyor device 157. The conveyor device 157 is placed into operation, thereby causing the stop 156 to convey the first printing plate 101, in a preferably tangential movement direction in relation to the plate cylinder 07, out of the chute 143 until its leading end 103 comes into contact with the contact pressure element 124, which is engaged against the plate cylinder 07. The suspension leg 113, that is angled at this plate leading end 103, is positioned between the rear edge 117 of the cylinder groove opening 109 in the production direction P of the printing cylinder 07 and the contact point of the contact pressure element 124 on the plate cylinder 07, as may be seen in FIG. 13.

The plate cylinder 07 now changes its direction of rotation and begins to rotate in its production direction P. This cylinder rotation causes the suspension leg 113 at the leading end 103 of the printing plate 101, which suspension leg 113 is resting on the plate cylinder 07, to slide into the cylinder groove opening 109, and thereby becoming suspended, in a positive connection, at the front edge 116 of the opening 109. As the plate cylinder 07 continues to rotate in its production direction P, the printing plate 101 is conveyed all the way out of the chute 143 and is drawn onto the plate cylinder 07. During printing plate mounting, the printing plate 101 is rolled onto the plate cylinder 07 by the pressure exerted by the contact pressure element 124, which is engaged against the plate cylinder 07. After one half of a complete rotation of the printing cylinder 07, in its production direction P, the contact pressure element 124 now pushes the angled suspension leg 114 at the trailing end 104 of the printing plate 101 into the opening 109. The holding assembly 121, which is situated in the groove 108 associated with this cylinder opening 109, has been released. It is therefore brought to its operating position in which it fastens, for example via clamping, the suspension leg 114 at the trailing end 104 of the printing plate 101, which has been inserted into the opening 109. The conveyor device 157 conveys the stop 156 that is connected to it, back to its final position on the side in the chute 143 that faces away from the printing cylinder 07, as may be seen, for example, in FIG. 14. The contact pressure element 124 is now disengaged from the printing cylinder 07, and the alignment device 151 preferably pivots its diametrically opposite stops 152; 153 back to a horizontal position.

Using the process steps as described thus far, a change of a first printing plate 101 on the printing cylinder 07 has been completed. A used printing plate 101 has been removed and a new printing plate 101 has been mounted.

A second printing plate 101 is changed substantially in accordance with the above-described process. Additional details on the process may be found specifically in the previously cited WO 2004/085160 A1 document.

Since the majority of printing plates 101 are typically mounted axially spaced on a respective plate cylinder 07, it will be preferably assumed in the subsequent discussion that, in a manner not specified in greater detail, a plurality of printing plates 101 are arranged side by side, in the axial direction of the plate cylinder 07, in the plate changing device 11. In this case, it is then expedient for each of the printing plates 101, which are arranged side by side, to each be assigned at least one contact pressure element 124, in a manner also not specified in greater detail. It is especially preferable for each at least one such contact pressure element 124 that is assigned to a printing plate 07 to be actuable independently of the other contact pressure elements 124 that are assigned to the other printing plates 101. This is appropriate so that each printing plate 101 can be fed in and can be removed independently of another printing plate 101.

To allow the plate changing device 11 to hold a plurality of printing plates 101 arranged side by side, the plate changing device 11 can be provided with a plurality of chute-like areas 141; 143 or chutes 141; 143. At least two chute-like areas 141; 143 can be arranged lying side by side. Preferably, the number of side by side chute-like areas 141; 143 corresponds to the number of printing plates 101 that can be arranged side by side axially on the assigned plate cylinder 07.

Moreover, and especially when two printing plates 101 are arranged one in front of another circumferentially on the plate cylinder 07, each plate changing device 11 can be provided with two chute-like areas 143; 141 which are arranged one above another. In this case, one of the two areas 143; 141, which are positioned one above another, is an infeed plane 143, such as, for example, an infeed chute 143, and the other of the two areas 141; 143 that are positioned one above another is a removal plane 141, such as, for example, a removal chute 141. Specifically, the arrangement is expediently such that the plate changing device 11 comprises a number of side by side infeed chutes 143 that corresponds to the number of printing plates 101 on the assigned plate cylinder 07, and to a corresponding number of removal chutes 141 arranged below the infeed chutes 143. The number of infeed chutes 143, which are arranged side by side in the plate changing device 11 can especially be four or six.

If a plurality of printing plates 101 are arranged side by side on a plate cylinder 07, each printing plate 101 must be assigned a groove 108, as is depicted for example in FIG. 4, or a section of such a groove 108 for use in holding the angled leading end 113 of one of the printing plates 101. It is preferably provided that for each of the printing plates 101 arranged side by side on the printing cylinder 107, a correspondingly longer groove 108 is provided, which longer groove 108 can preferably be embodied as being continuous in the axial direction of the plate cylinder 07.

As was previously described, holding devices 119, for use in holding the suspension legs 113 of the printing plates 101, are provided in the cylinder grooves 108, and can especially comprise the holding assembly 121, the spring elements 122 and the actuating elements 123. To allow a plate change to be carried out for each printing plate 101 independently of a plate change of another printing plate 101, when a plurality of printing plates 101 are arranged side by side axially on a plate cylinder 07, each printing plate 101 is provided with its own holding device 119. Each such holding device 119 can be actuated independently of the other holding devices 119. As discussed previously, each such holding device 119 is preferably pneumatically actuated.

In the previous discussion, which is associated with the depiction of FIG. 9 through 14, the plate changing process was described for cases in which the production direction P coincides with the infeed direction of the printing plates 101. In the case of printing couples 03; 21; 29; 32, as seen in FIGS. 1 and 2, the plate changing process is generally as described above. In the case of the other printing couples 04; 22; 28; 31 the plate changing process differs as will be discussed below.

Figure 5:
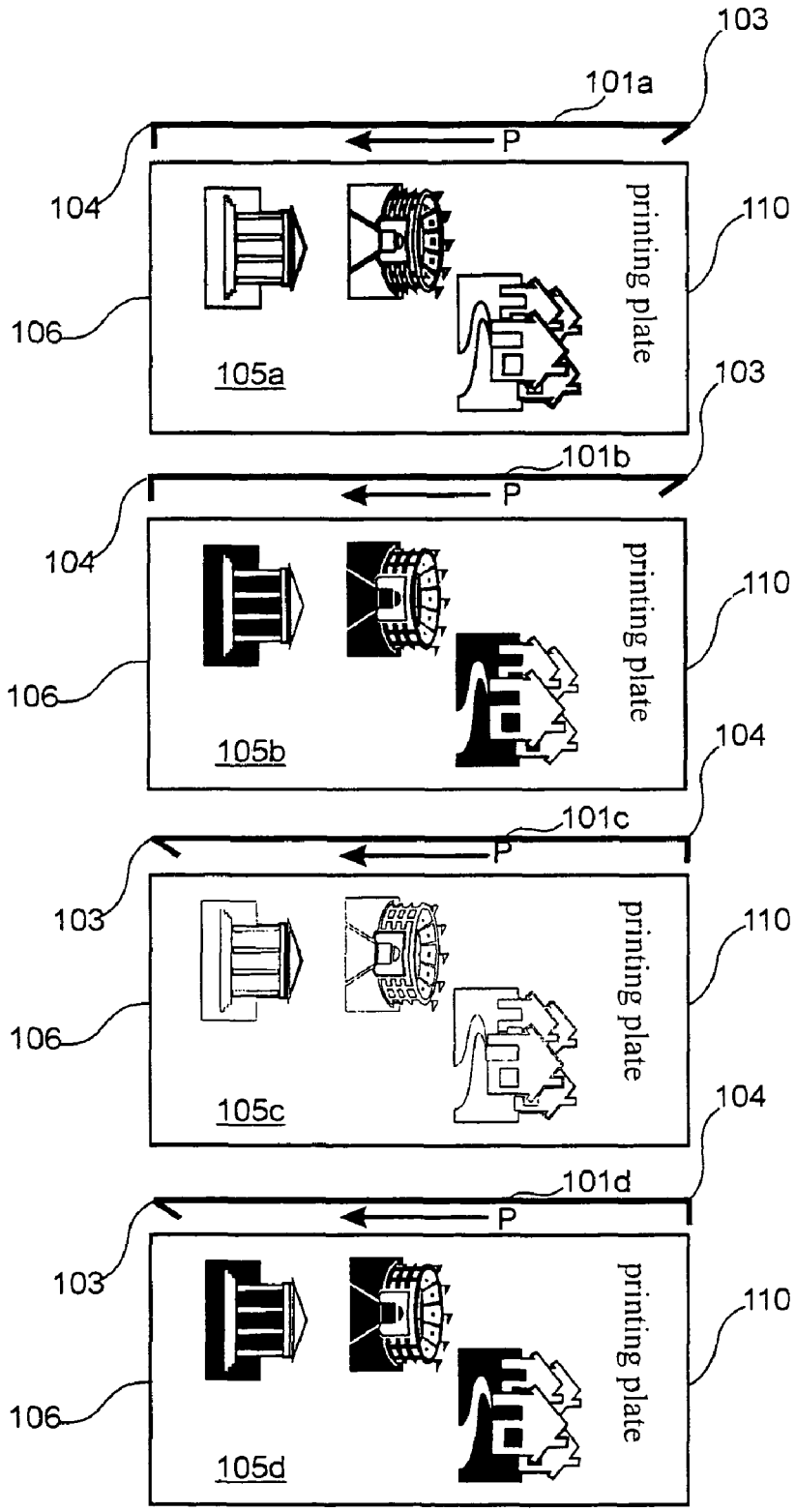
FIG. 5 a representation of the different orientation of the printing plates or of the print images applied to these, in the example of a four-color printing system, for example in a nine-cylinder satellite printing unit of FIG. 1.

Reference will initially be made again to FIG. 1. It is assumed that, in the lower nine-cylinder satellite printing unit 16, the web of print substrate 23 is printed in sequence in printing couple 22 with the color black, in printing couple 04 with the color cyan, in printing couple 03 with the color magenta and in printing couple 21 with the color yellow. Accordingly, printing plates 101*a*; 101*b*; 101*c* and 101*d*, as seen in FIG. 5 and which are respectively assigned to printing couples 22; 04; 03; 21, each carry a print images 105 for the corresponding color. The printing plates 101*a* that is assigned to printing couple 22 carry a print image 105*a* for the color black. The printing plates 101*b* assigned to printing couple 04 carry a print image 105*b* for the color cyan. The printing plates 101*c* assigned to printing couple 03 carry a print image 105*c* for the color magenta. The printing plates 101*d* assigned to printing couple 21 carry a print image 105*d* for the color yellow, all as is illustrated schematically in FIG. 5.

FIG. 5 shows a diagram of the printing plates 101*a*; 101*b*; 101*c* and 101*d* with the assigned print images 105*a*; 105*b*; 105*c* and 105*d* for this nine-cylinder satellite printing unit 16. The orientation of the print images 105*a*; 105*b*; 105*c* and 105*d* relative to the respectively assigned printing plates 101*a*; 101*b*; 101*c* and 101*d* is also apparent. The respective arrows indicate the production direction P or running direction P of each respective printing plate 101*a*; 101*b*; 101*c* or 101*d* on the corresponding plate cylinder 07 during production operation. The leading end of each print image 105*a*; 105*b*; 105*c*; 105*d* in production operation is identified by the reference symbol 106, and the trailing end of each print image in the production process is identified by the reference symbol 110. As is apparent from a review of FIG. 5, print images 105*a* and 105*b* are mounted on the respective printing plates 101*a* and 101*b* in the opposite orientation from print images 105*c* and 105*d*. It is further apparent that the orientation of printing plates 101*a* and 101*b* relative to the production direction P is opposite the orientation of printing plates 101*c* and 101*d*. Ultimately, all of the print images 105*a*; 105*b*; 105*c* and 105*d* are aligned in the same orientation with respect to the production direction P.

The process of mounting printing plates 101*a*; 101*b*, in the case of printing couples 22 and 04, is then implemented such that each of the corresponding printing plates 101*a*; 101*b* is suspended with its first end 103 on the first front edge 116 of the plate cylinder 07. The direction of rotation of the corresponding plate cylinder 07 is then reversed, for the purpose of mounting the printing plates 101*a*; 101*b*, until the second end 104 of each printing plate 101*a*; 101*b* is also suspended and fastened on the second rear edge 117 of the plate cylinder 07. The direction of rotation of the plate cylinder 07 is then reversed again to return it to the production direction P for a subsequent print operation. In the case of these printing plates 101*a*; 101*b*, the running direction P, during print operation, is such that the second end 104, which in accordance with the prior art is usually the trailing end, is now the leading end.

The above discussion and procedures can be correspondingly applied to the upper nine-cylinder satellite printing unit 17. In this case, the printing couples 31; 28 are those printing couples 31; 28 in which the second ends 104 of the printing plates 101*c* and 101*d* are the leading ends in print operation, and the print images 105*c* and 105*d* carried by those printing plates are applied in an orientation which is opposite to that of the prior art. In the described preferred embodiment, in the case of the nine-cylinder satellite printing unit 17, the colors magenta and yellow are assigned to these printing couples 31; 28, respectively.

Figure 15:
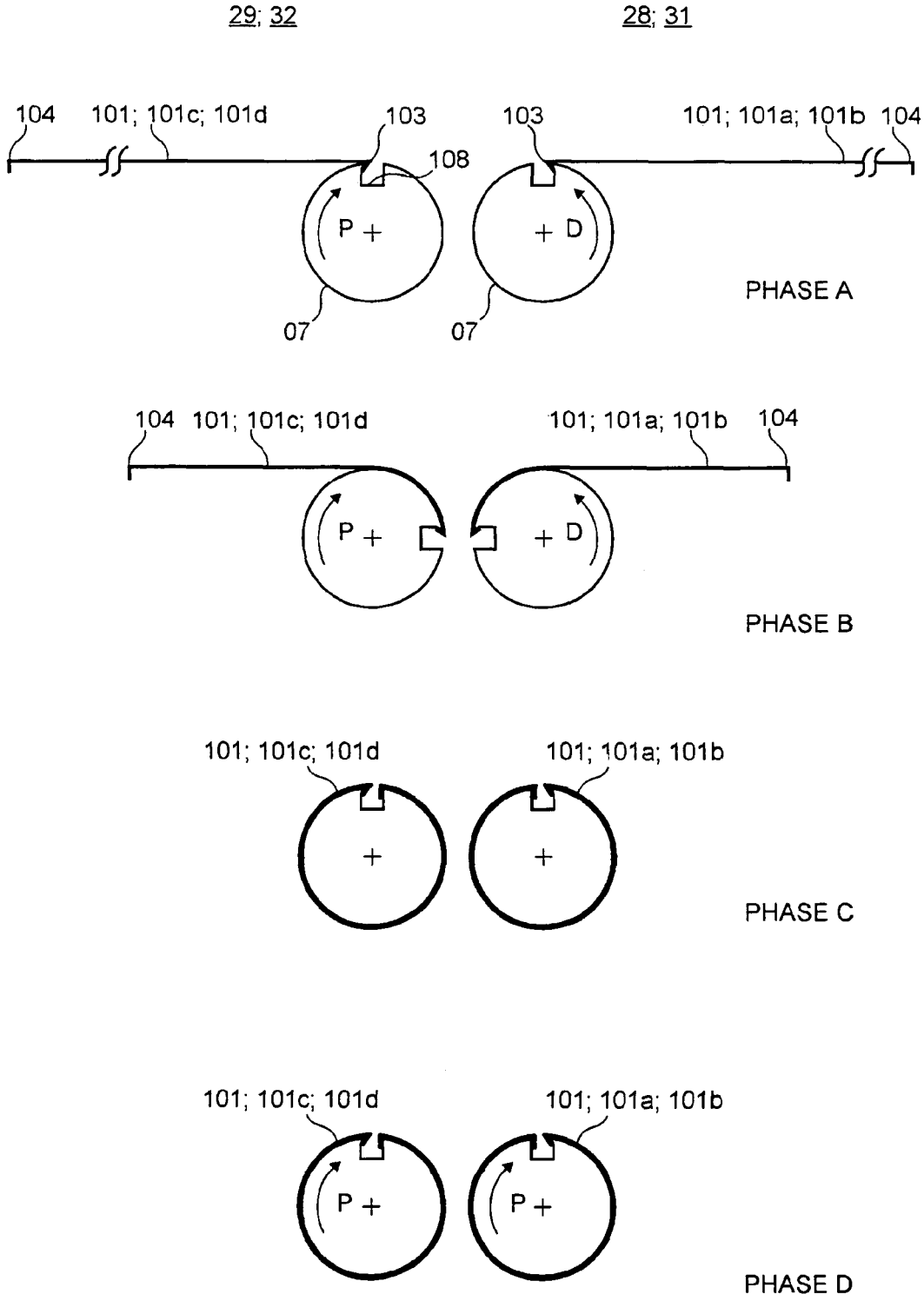
FIG. 15 a schematic depiction of various sequential operating phases for plate cylinders of a nine-cylinder satellite printing unit of a printing tower of FIG. 1, for example.

The above-discussed arrangements of plate mountings and orientations are schematically illustrated again in FIG. 15. This figure shows various operating phases of the plate cylinders 07, for example of the printing couples 29; 28 or 32; 31. In phase A, the first end 103 of the respective printing plate 101 has been suspended in the groove 108 of the plate cylinder 07, or more precisely over its first front edge 116, and the process of mounting a printing plate 101 is beginning. In phase B, the plate cylinder 07 rotates to draw on the printing plate 101 and the printing plate 101 is already partially mounted. In phase C, mounting the printing plate 101 on the plate cylinder 07 has been completed, and therefore the second end 104 of the printing plate 101 has also been suspended in the groove 108, or more precisely, has been suspended and fastened over its second rear edge 117. In phase D, the plate cylinder 07 rotates in the production direction P for the purpose of printing. The left column shows a plate cylinder 07, for example, of printing couples 29; 32, and the right column shows a plate cylinder 07, for example, of printing couples 28; 31 of the nine-cylinder satellite printing unit 17. This procedure can be correspondingly applied to the nine-cylinder satellite printing unit 16. However, the arrangement is a mirror image around a vertical center plane M.

As is shown in the left column of FIG. 15, the plate cylinder 07 also rotates in the production direction P during the phase in which the printing plate 101*c*; 101*d* is being mounted. However, in the case of the right column, the direction of rotation D of the plate cylinder 07 is oriented opposite the cylinder's production direction P when a printing plate 101*a*; 101*b* is being mounted. This direction of rotation is reversed once mounting is complete and the plate cylinder is returned to its direction of rotation that is needed for proper printing.

In the case of the above-described preferred embodiments, the circumference of the satellite cylinder 18 corresponds to the circumference of the plate cylinder 07 or of the forme cylinder 07. If the circumference of the plate cylinder 07 is one page, and especially is one newspaper page, the circumference of the satellite cylinder 18 also corresponds to one page, and especially to one newspaper page. If the circumference of the plate cylinder 07 is two pages, and especially is two newspaper pages, the circumference of the satellite cylinder 18 also corresponds to two pages, and especially to two newspaper pages. Thus in the first alternative described above, the circumference of the satellite cylinder 18 is equal to the cut-off length of the plate cylinder 07, and in the second alternative described above, the circumference of the satellite cylinder is equal to twice the cut-off length of the plate cylinder 07.

In general, the circumferential ratio of satellite cylinder 18 to plate cylinder 07 can especially be structured such that the circumference of the satellite cylinder 18 corresponds to a whole number multiple of the cut-off length of the plate cylinder 07.

Figure 16:
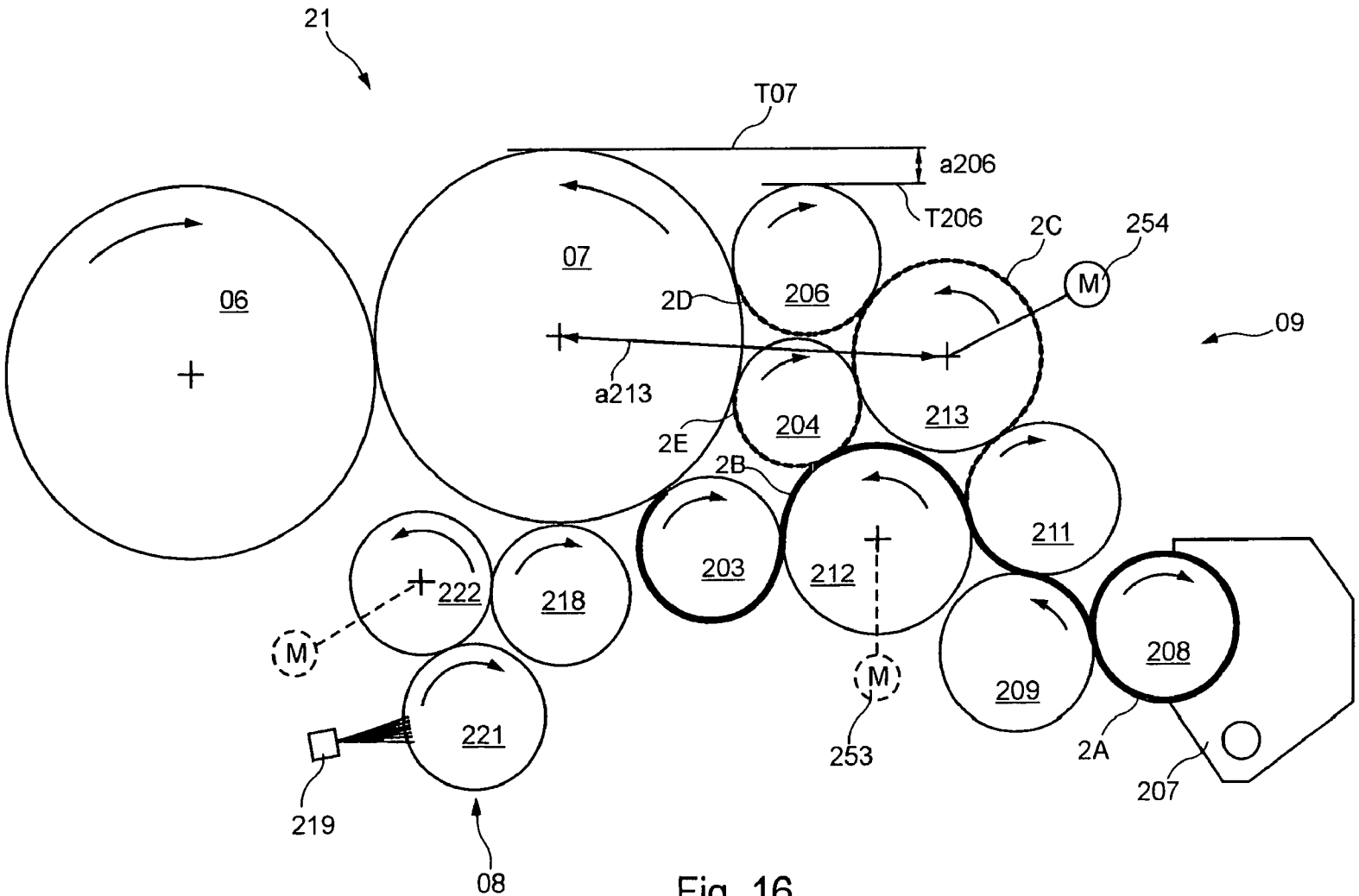
FIG. 16 a schematic side elevation view of a part of a printing couple, and including an inking unit and a dampening unit, of a nine-cylinder satellite printing unit of a printing tower of FIG. 1, for example.

In FIG. 16, a part of the printing couple 21 of the printing tower 14 of FIG. 1 is represented by way of example. The other printing couples 03; 04; 22; 28; 29; 31; 32 are correspondingly structured.

In the embodiment which is represented in FIG. 16, the rotary printing press operates using a wet-offset printing process. With each of its revolutions, the transfer cylinder 06 generates at least one printed image on the web of print substrate 23, which preferably is a web of paper 23. In the case of the printing couple 21 represented in FIG. 16, at least one inking unit 09 and one dampening unit 08 are engaged with the forme cylinder 07.

The inking unit 09 has a plurality of rollers, and particularly has three rollers 203; 204; 206. These may be, for example, configured as ink forme rollers 203; 204; 206, which are engaged against the forme cylinder 07 when the rotary printing press is in a running production process. A plurality of rollers 209; 211; 212; 213 are arranged between an ink fountain roller 208, which picks up ink from an ink reservoir 207, and the ink forme rollers 203; 204; 206, which apply the ink to the forme cylinder 07. The roller 209, which follows directly behind the ink fountain roller 208, in the direction of transport of the ink, is configured as a film roller 209. In the direction of transport of the ink, downstream from the film roller 209, a roller 211, which is configured as an ink flow dividing roller 211, is provided, which ink flow dividing roller 21 divides an ink flow 2A coming from the ink fountain roller 208 into a primary flow 2B and a secondary flow 2C. In FIG. 16, the path of the primary flow 2B, which leads to the forme cylinder 07, is indicated by a solid line, and the path of the secondary flow 2C, which also leads to the forme cylinder 07, is indicated by a dashed line.

Rollers 212; 213 are arranged in the primary flow 2B and in the secondary flow 2C respectively. These rollers 212; 213 transfer ink from the ink flow dividing roller 211 to at least one of the ink forme rollers 203; 204; 206. Each of these rollers 212; 213 is structured as a distribution roller 212; 213. The two ink distribution rollers 212; 213 each execute an oscillating movement which extends in its respective axial direction. The oscillating movement of one distribution roller 212 can be coupled with the oscillating movement of the other distribution roller 213 via a lever assembly, for example. In an alternative embodiment, the oscillating movement of each of the respective distribution rollers 212; 213 is generated by drives that are independent of one another. In both drive variants, the two oscillating movements can extend opposite to one another. For example, the oscillating movement of the respective distribution roller 212; 213 can be generated from its rotational movement by the provision of a suitable transmission. Both in the primary flow 2B and in the secondary flow 2C, ink which has been picked up from the ink reservoir 207, is applied to the forme cylinder 07 by a roller train comprised of five rollers 208; 209; 211; 212; 213; 203; 204; 206 arranged in a row. Each roller train leading to the forme cylinder 07 contains the following components: the ink fountain roller 208, the film roller 209, the ink flow dividing roller 211, one of the distribution rollers 212; 213 and one of the ink forme rollers 203; 204; 206. Accordingly, only a single roller 209 is arranged in the roller train between the ink fountain roller 208 and the ink flow dividing roller 211. This roller 209 is embodied as a film roller 209.

The primary flow 2B is the part of the ink flow 2A, which is coming from the ink fountain roller 208, and which is picked up by the ink flow dividing roller 211, in the direction of rotation of the ink flow dividing roller 211, and which is then the first flow to be carried in the direction of the forme cylinder 07 via the distribution roller 212 arranged in this primary flow 2B. The secondary flow 2C of the ink picked up from the ink reservoir 207 is that part of the ink flow 2A coming from the ink fountain roller 208 which is picked up from the ink flow dividing roller 211 downstream from the primary flow 2B in the direction of rotation of the ink flow dividing roller 211, and which is passed on in the direction of the forme cylinder 07. The secondary flow 2C can, in turn, be divided into additional partial flows 2D; 2E, if a plurality of ink forme rollers 204; 206; 203, especially two, are engaged against the distribution roller 213 which is itself arranged in the secondary flow 2C. Because the primary flow 2B of the ink flow 2A, which is coming from the ink fountain roller 208, is the first to reach the forme cylinder 07 in its direction of rotation, at least spatially in front of the secondary flow 2C and its partial flows 2D; 2E, such an inking unit 09 as the one seen in FIG. 16 is referred to as being front-loaded. The ink which is transported in the secondary flow 2C of the ink flow 2A that is coming from the ink fountain roller 208 is applied, for example, to the forme cylinder 07, which has already been inked by the primary flow 2B. The ink forme rollers 204; 206 that belong to the secondary flow 2C, and that carry its partial flows 2D; 2E, also smooth out the part of the ink which was previously applied to the forme cylinder 07 in the primary flow 2B. Such an inking unit 09 generates a uniform application of ink to the forme cylinder 07 to be inked up. An inking unit 09 in which the primary flow 2B of the ink flow 2A coming from the ink fountain roller 208 is applied to the forme cylinder 07 in its direction of rotation only after the secondary flow 2C and its partial flows 2D; 2E are applied to the forme cylinder 07 is referred to as a rear-loaded inking unit.

The ink reservoir 207, from which the ink fountain roller 208 picks up the ink to be transported to the forme cylinder 07, is embodied, for example, as an ink fountain 207 or as an ink trough 207. A plurality of ink blades, which are not specifically shown, such as, for example, thirty to sixty ink blades are provided in a row on the ink fountain 207 or on the ink trough 207 in the axial direction of the ink fountain roller 208. Each of these ink blades can be adjusted in terms of its respective engagement against the ink fountain roller 208, and is actually engaged against that ink fountain roller 208, preferably remotely, via an adjustment mechanism, which is not specifically shown, thereby enabling a zonal metering of the ink which is picked up by the ink fountain roller 208. The metering of the quantity of ink, that is performed by the adjusting of the respective ink blade, is manifested in an ink film thickness which is proportional to this adjustment, in the relevant zone on the circumferential surface of the ink fountain roller 208. Accordingly, in the preferred embodiment the inking unit is structured as a zonal inking unit.

The lengths of the rollers 203; 204; 206; 208; 209; 211; 212; 213 of the inking unit 09, in their respective axial directions, range, for example, from 500 mm to 2,600 mm, and especially range from 1,400 to 2,400 mm. Their outer diameters range from 50 mm to 300 mm, for example, and preferably range from 80 mm to 250 mm. The circumferential surface of the ink flow dividing roller 211 is preferably made of a flexible material, such as, for example, a rubber.

The dampening unit 08, which is also depicted schematically in FIG. 16, is preferably embodied as a dampening unit 08 that applies a dampening agent in a contactless manner, such as, for example, as a spray dampening unit. It thus preferably has a spray bar 219. A plurality of spray nozzles are arranged in the spray bar 219 and preferably spray the dampening agent onto a roller 221 of the dampening unit 08, which roller 221 is embodied, for example, as a dampening distribution roller 221. The dampening agent that is sprayed onto the dampening distribution roller 221 is transferred by another roller 222 of the dampening unit 08, which may be embodied as a smoothing roller 222, for example, onto its dampening forme roller 218 and from there to the forme cylinder 07.

In FIG. 16, the direction of rotation of the respective rollers 203; 204; 206; 208; 209; 211; 212; 213 of the inking unit 09, the direction of rotation of the rollers 218; 221; 222 of the dampening unit 08 and the direction of rotation of the cylinders 06; 07 is indicated, in each case, by an arrow. The cylinders 06; 07 are driven as has previously been described. In the inking unit 09, only one of the distribution rollers 212; 213, namely either the distribution roller 212 or the distribution roller 213, is driven by a drive 253; 254, such as, for example, by an electric motor 253; 254. In FIG. 16, the preferred embodiment is represented, in which the distribution roller 213 is driven and the distribution roller 212 has no motor. The other alternative is indicated by a drive 253 represented by dashed lines for distribution roller 212. The remaining rollers 203; 204; 206; 208; 209; 211 of the inking unit 09 are actuated via friction and therefore do not have their own motorized drive. To allow the center ink forme roller 204 to be changed, the upper distribution roller 213 can be pivoted, via a mechanical device, in a direction that will increase its axial distance a213 from the forme cylinder 07. The center ink forme roller 204 can then be removed from the area between the forme cylinder 07 and the upper distribution roller 213 substantially by a movement directed vertically upward.

The uppermost ink forme roller 206 of the inking unit 09 is arranged such that, in its operating position in which it is engaged against the forme cylinder 07, a horizontal tangent T206, which is placed on the periphery of this ink forme roller 206, is located a vertical distance a206 of at least 50 mm below a horizontal tangent T07 which is placed on the periphery of the forme cylinder 07. This vertical distance a206 forms an offset, so to speak, between the uppermost ink forme roller 206 and the forme cylinder 07. This arrangement allows sufficient access to the forme cylinder 07 from an operating side of the printing couple 21. This is especially true if all the remaining rollers 203; 204; 208; 209; 211; 212; 213 belonging to the inking unit 09 are positioned substantially below the horizontal tangent T206 which is placed on the periphery of the uppermost ink forme roller 206. The rollers 218; 221; 222 of the dampening unit 08 are positioned substantially below the forme cylinder 07, and also do not restrict access to the forme cylinder 07. Accessibility of, and to the forme cylinder 07 is necessary, for example, to allow one or more printing formes 101 which are positionable on the circumferential surface of the forme cylinder 07 to be changed within the shortest possible time. A change of printing formes 101 on the forme cylinder 07 can be performed automatically with the help of a plate changing device 11, which is preferably engaged tangentially against the forme cylinder 07.

Despite the relatively low number of ink gap positions in the roller train that transports ink to the plate cylinder 07, the inking unit 09 depicted in FIG. 16 generates a uniform ink application on the plate cylinder 07. This is because more rollers are provided where they are especially needed for smoothing the applied ink, namely in direct contact with the plate cylinder 07, where preferably three ink forme rollers 203; 204; 206 are provided. Especially with a special, namely stochastic, structure of the circumferential surface of the film roller 209, the depicted inking unit 09 is not prone to ghosting. As a result, a high quality printed product can be produced using this inking unit 09, even in newspaper printing, which allows for the ever-increasing demand for quality in newspaper printing. Even in a high-speed printing press, in which the transport speed of the print substrate 23 exceeds 10 m/s, and preferably ranges from 10 m/s to 15 m/s, as is customary in newspaper printing, the undesirable effect of ink misting rarely occurs due to the short roller train and the film roller 209 that is used. The use of the inking unit 09 described with reference to FIG. 16 in a rotary printing press, and especially in a newspaper printing press which is configured as a printing tower 14, will be described in greater detail in reference to the subsequent figures.

Figure 17:
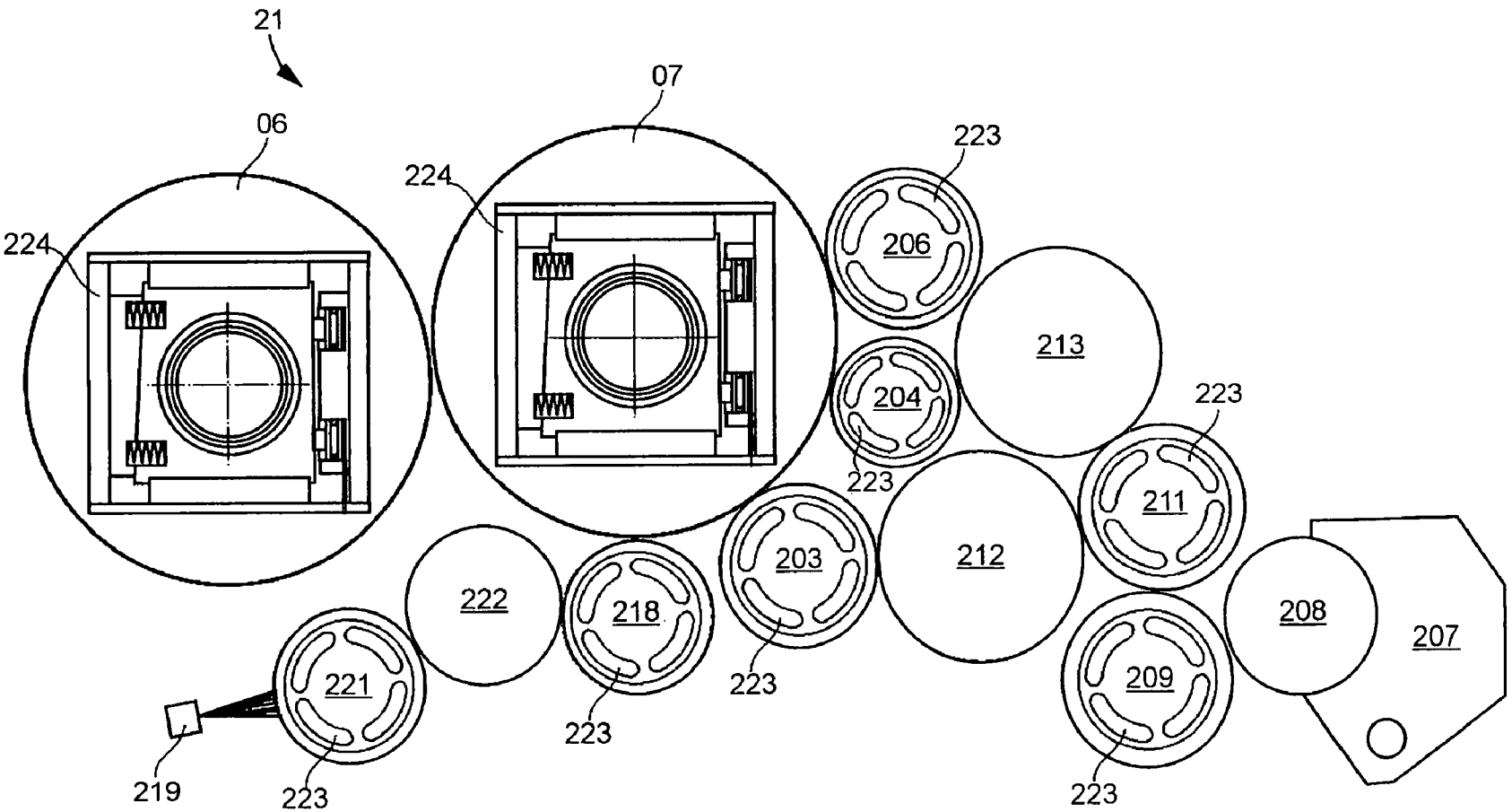
FIG. 17 a depiction of the part of the printing couple shown in FIG. 16, and showing a mounting of the cylinders and with an adjustment device on each of various rollers, wherein each of the roller trains is closed.
Figure 18:
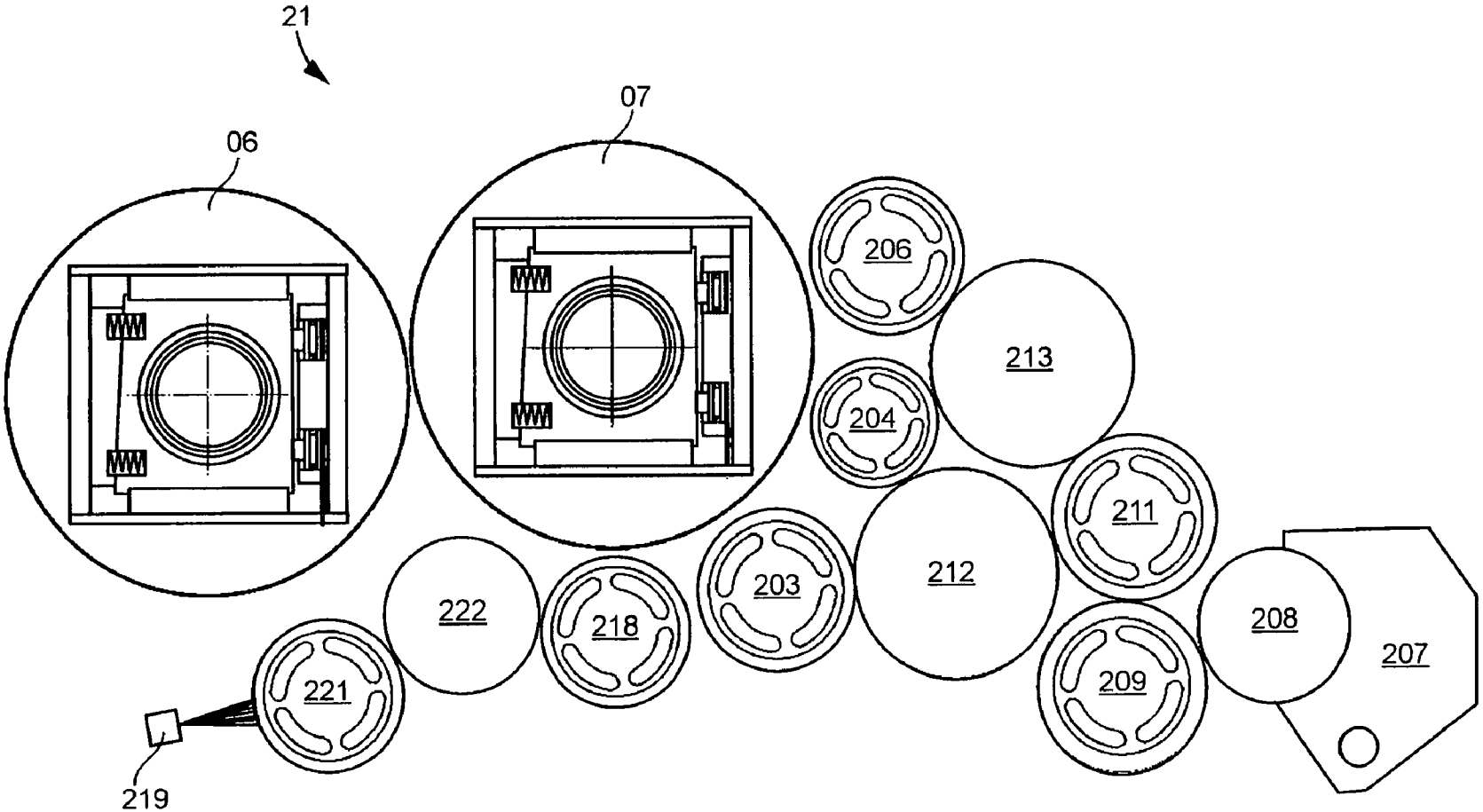
FIG. 18 another depiction of the part of the printing couple shown in FIG. 16, and showing a mounting of the cylinders and with an adjustment device on each of various rollers, wherein the roller trains are separated by a gap.

FIGS. 17 and 18 show additional schematic representations of the part of the printing couple 21 that is shown in FIG. 16. In this case, especially the mounting of the cylinders 06; 07 and a respective adjustment device for the ink forme rollers 203; 204; 206, the film roller 209, the ink flow dividing roller 211, the dampening forme roller 218 and the dampening distribution roller 221 are emphasized. The representations in FIGS. 17 and 18 differ from one another. FIG. 17 shows a first operating position in which each of the roller trains is preferably closed. This means that, for example, the ink forme rollers 203; 204; 206 are engaged against the forme cylinder 07 and against one of the distribution rollers 212; 213, and that the dampening forme roller 218 is engaged against the forme cylinder 07 and against the smoothing roller 222. FIG. 18, in contrast, shows a second operating position in which the roller trains are preferably open, or are interrupted by a gap. This means that, for example, the ink forme rollers 203; 204; 206 and/or the dampening forme roller 218 are disengaged at least from the forme cylinder 07.

All the rollers 203; 204; 206; 208; 209; 211; 212; 213 of the inking unit 09, the rollers 218; 221; 222 of the dampening unit 08, and the cylinders 06; 07 are rotatably mounted in frames 02 and 27 of the printing tower 14, as may be seen in FIG. 1, which frames 02 and 27 are positioned spaced from, and opposite to one another. At least the ink forme rollers 203; 204; 206 and the dampening forme roller 218, but preferably also the film roller 209 and the ink flow dividing roller 211, of the inking unit 09, and the dampening distribution roller 221 of the dampening unit 08, are each situated so as to be capable of accomplishing radial movement. The radial movement of these rollers 203; 204; 206; 209; 211; 218; 221 refers to the fact that the respective axes of these rollers 203; 204; 206; 209; 211; 218; 221, or of at least one of the ends of these rollers 203; 204; 206; 209; 211; 218; 221, can be displaced eccentrically in relation to a bearing point which is fixed on the frame and which belongs to the respective roller 203; 204; 206; 209; 211; 218; 221. The eccentric displacement of each of the rollers 203; 204; 206; 209; 211; 218; 221 is accomplished, preferably with the help of a plurality of actuators 223, such as, for example, four such actuators. These actuators are arranged symmetrically and concentrically around the respective axes of these rollers 203; 204; 206; 209; 211; 218; 221, as is represented by way of example in FIGS. 17 and 18. Those actuators 223 that belong to the same roller 203;

204; 206; 209; 211; 218; 221 can be actuated individually and independently of one another via a control unit, and can each be adjusted to a specific adjustment path. Each actuated actuator 223 exerts a radial force with respect to the roller 203; 204; 206; 209; 211; 218; 221 to which it belongs. This radial force displaces the axis of each roller 203; 204; 206; 209; 211; 218; 221 radially, or at least attempts to displace it. When a plurality of actuators 223, which are arranged at the same end of one of the rollers 203; 204; 206; 209; 211; 218; 221 are actuated simultaneously, the radial movement which is executed by the axis of the respective roller 203; 204; 206; 209; 211; 218; 221 results from a vector sum of the respective radial forces of the actuated actuators 223. The actuators 223 are pressurized, for example, by a pressure medium. Preferably, they are pneumatically actuated. Each one of the actuators 223 is situated, for example, in a roller socket, with each such roller socket accommodating one end of the respective roller 203; 204; 206; 209; 211; 218; 221. The radial movement that can be executed by the axis of each respective roller 203; 204; 206; 209; 211; 218; 221 preferably lies within the range of a few millimeters, such as, for example, a range of 10 mm, which range is sufficient to disengage the respective roller 203; 204; 206; 209; 211; 218; 221 from at least one adjacent cylindrical rotational body, such as, for example, the forme cylinder 07. The respective actuators 223 may also be used to adjust a contact pressure that is exerted by the respective roller 203; 204; 206; 209; 211; 218; 221 against its at least one adjacent rotational body. The degree of adjusted contact pressure influences the quality of the printed product which may be produced in connection with this inking unit 09 and/or dampening unit 08 by influencing the transport of ink or of dampening agent that is controlled with this adjustment. The contact pressure is built up if there is already direct contact between the respective roller 203; 204; 206; 209; 211; 218; 221 and its adjacent rotational body. Nevertheless, with the actuation of one or more actuators 223, the at least one effective radial force is increased. With the continued or renewed actuation of one or more actuators 223, the amount of existing contact pressure can be adjusted, and also can, for example, even be decreased.

With the adjustment of the contact pressure that is exerted by one of the rollers 203; 204; 206; 209; 211; 218; 221 on its adjacent rotational body, the width of a roller strip that is formed by the direct contact between this roller 203; 204; 206; 209; 211; 218; 221 and the adjacent rotational body is also adjusted. The roller strip is represented as a flattened area on the circumferential surface of the roller 203; 204; 206; 209; 211; 218; 221, on the circumferential surface of the cylindrical rotational body that cooperates with the roller 203; 204; 206; 209; 211; 218; 221, or on the circumferential surfaces of both. The width of the roller strip is the chord that is formed as a result of the flattening of the otherwise circular cross-section of the roller 203; 204; 206; 209; 211; 218; 221 or of the rotational body that cooperates with it. The flattening is possible due to an elastically deformable circumferential surface of the roller 203; 204; 206; 209; 211; 218; 221 or of the rotational body that cooperates with it. A roller strip is also referred to as a nip point. In the control unit which controls the actuators 223, values for the respective pressure levels to which the respective actuators 223 are to be adjusted can be stored. This is done in order to generate a roller strip of a specific width for a specific roller 203; 204; 206; 209; 211; 218; 221 with its adjacent rotational body, by virtue of the contact pressure resulting from the respective adjustment of each of the actuators 223.

Figure 19:
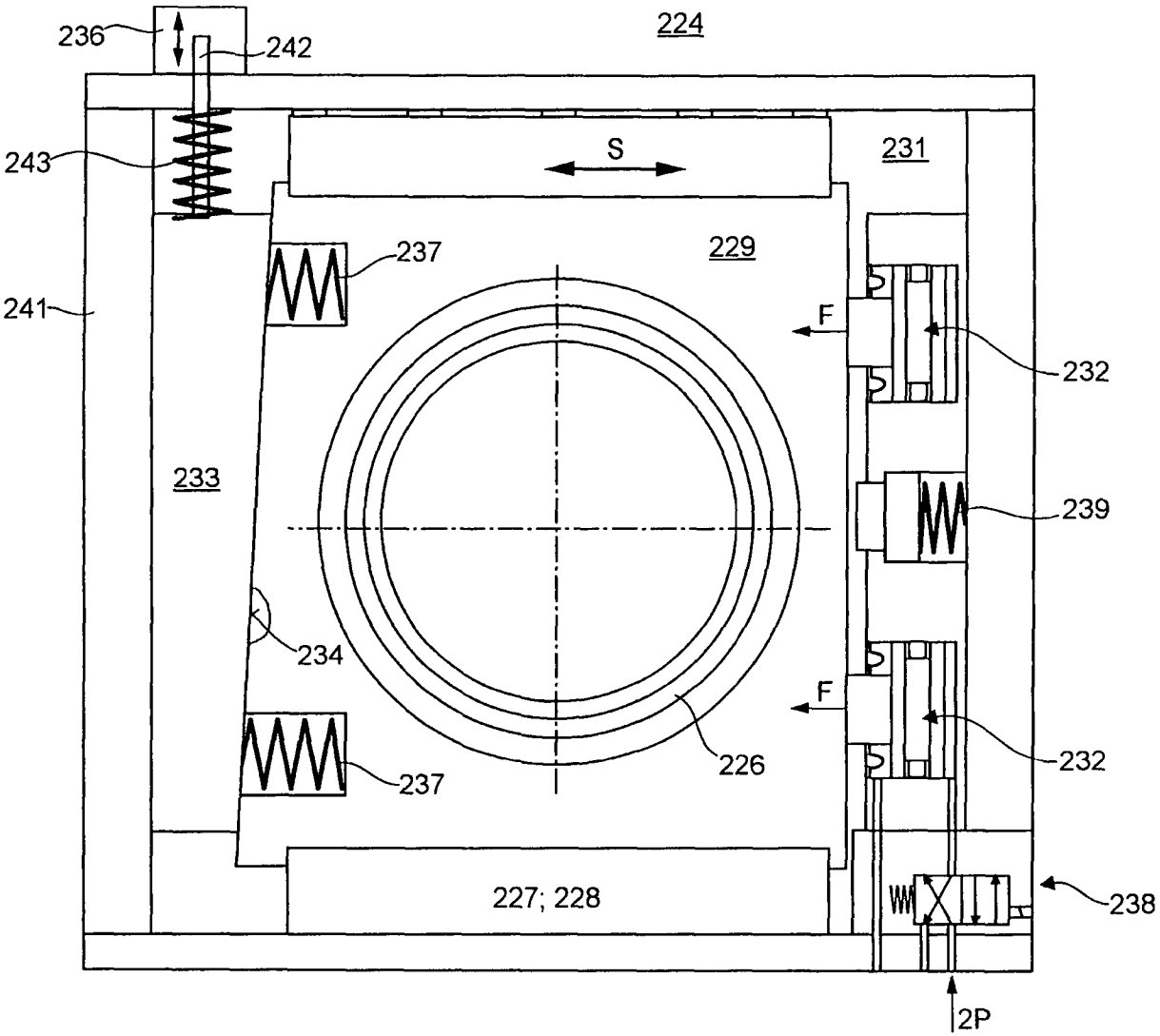
FIG. 19 a schematic cross-sectional representation of a bearing unit of a cylinder, for example according to FIG. 2 or 17, or according to FIG. 18.

The cylinders 06; 07, such as, for example, the transfer cylinder 06 and the forme cylinder 07, are each mounted in a bearing unit 224, in accordance with their representation in FIGS. 17 and 18. Each end of the respective printing couple cylinders 06; 07 is preferably respectively mounted in a bearing unit 224 of this type, such as, for example, a linear bearing 224. The bearing unit 224 allows a linear adjustment path S for the respective cylinder 06; 07. Details of the preferred bearing unit 224 are shown in FIG. 19.

In addition to a bearing 226, such as, for example, a radial bearing 226, for example a cylinder roller bearing 226, which is usable for the rotary mounting of the respective cylinder 06; 07, the bearing unit 224, which integrates an engagement/disengagement mechanism for the respective cylinder 06; 07, also comprises bearing elements 227; 228 for accomplishing a radial movement of the respective cylinder 06; 07—for print-on and/or print-off adjustment. For this purpose, once the bearing unit 224 has been installed in, or on a frame of the printing press, that bearing unit 224 has bearing elements 227 which are fixed to a frame and to the support, and further has bearing elements 228 which can be moved in relation to these bearing elements 227. The bearing elements 227; 228, which are respectively either fixed to the support or are movable, are configured as cooperating linear elements 227; 228, thereby forming a linear bearing 227, 228 together with corresponding sliding surfaces or roller elements which are situated between them. Pairs of linear elements 227; 228 hold a bearing block 229 between them, which bearing block 229 is configured, for example, as a sliding carriage 229 and which accommodates the radial bearing 226. Bearing block 229 and the movable bearing elements 228 can also be embodied as a single piece. The bearing elements 227, which are fixed to the support, are arranged on a support 231, which will be, or is connected as a unit to one of the frames 02; 27, which are seen in FIG. 1. The support 231 may be configured, for example, as a support plate, which has, for example, an opening that is configured to accommodate a shaft, such as, for example, a drive shaft of a cylinder journal, which is not represented in FIG. 19, and which is positioned at least on one drive side of the respective cylinder 06; 07. The frame panel on the drive side also preferably has a recess or an opening for a drive shaft. On the end surface which is opposite to the drive side, it is not absolutely necessary for a recess or for an opening to be provided in the frame 02; 27.

Preferably, a length of the linear bearing 227, 228, and especially at least a length of the bearing element 227 of the linear bearing 227, 228, which, when mounted, is fixed to the frame, is smaller than a diameter of the allocated cylinder 06; 07, as viewed in the direction of the adjustment path S. The bearing block 229 preferably has only a single degree of freedom of motion in the direction of the adjustment path S, as indicated by the double-headed arrow in FIG. 19.

The bearing unit 224, which is preferably configured as a component that can be installed as a unit, forms, for example, an optionally partially open housing from, for example, the support 231 and/or, for example, a frame. In FIG. 19, for example, this frame is formed by the four plates that border the bearing unit 224 on all four sides toward the outside, which four plates are not specifically identified by reference symbols. The bearing block 229 with the radial bearing 226, the bearing elements 227; 228, such as, for example, the linear guides 227; 228, configured for example as linear bearings 227; 228, and, in an advantageous embodiment, for example, an actuator 232, or a plurality of such actuators 232, which displace the bearing block 229 in a linear fashion, are all housed inside this housing or this frame. The bearing elements 227, which are fixed to the frame, are arranged substantially parallel to one another and define the direction of the adjustment path S, as may be seen in FIG. 19.

A print-on adjustment is performed by moving the bearing block 229 in the direction of the print position, by the application of a force F, which is applied to the bearing block 229 by at least one actuator 232, and especially by at least one power-controlled actuator 232. Through the use of this at least one actuator 232, a defined or definable force F can be applied to the bearing block 229 in the print-on direction for the purpose of adjustment, again as seen in FIG. 19. The linear force at the respective nip point, which is decisive for ink transfer and therefore for print quality, among other factors, is therefore defined not by an adjustment path S, but by the equilibrium of forces between the force F and a linear force which results between the cylinders 06; 07, and the resulting equilibrium. In a first embodiment, which is not specifically shown, the cylinders 06; 07 are engaged against one another in pairs, in that the bearing block 229 is acted upon by the correspondingly adjusted force F via the actuator or actuators 232. For adjusting the basic setting of a system, with corresponding adjustments to the cylinders 06; 07, one advantageous embodiment provides that at least the respective transfer cylinder 06 of the printing couple 03; 04; 21; 22; 28; 29; 31; 32 can be fixed in place, or at least can be limited in terms of movement, in a position of adjustment which is determined by the equilibrium of forces.

Particularly advantageous is an embodiment in which the bearing block 229 is mounted such that it can move in at least one direction away from the print position against a force, such as, for example, against a spring force, and especially a definable force, even when the printing press is running. In this manner, in contrast to a mere restriction of movement, on one hand a maximum linear force is defined by the cooperation of the cylinders 06; 07, and on the other hand a yielding is enabled, for example in the case of a web tear, which force may thus be associated with a resulting paper jam on one of the cylinders 06; 07.

On its side that faces a print position, the bearing unit 224 has a stop 233 which is movable, at least during the adjustment process, and which limits the path of adjustment S up to the print position. The stop 233, which is shown in FIG. 19, can be moved in such a way that a stop surface 234, which functions as a stop, and the reference symbol of which is indicated in FIG. 19 in a cutout area of the bearing block 229, can be varied in at least one area along the path of adjustment S. Thus, in one advantageous embodiment, the adjustable stop 233 represents an adjustment device with which the location of an end position of the bearing block 229, which end position is close to the print position, can be adjusted. For use in the restriction of movement/adjustment, a wedge drive, as described below, is provided, for example. In principle, the stop 233 can be adjusted manually or via an adjustment element 236 which can be embodied as an actuator 236.

Also provided in an advantageous embodiment of the present invention is a holding or clamping element, which is not specifically illustrated in FIG. 19, and with which the stop 233 can be secured in a desired position. Moreover, at least one spring-force element 237, such as, for example, spring element 237, is provided, which exerts a force $F_R$ from the stop 233 on the bearing block 229 in a direction that is facing away from the stop. In other words, the spring element 237 effects an adjustment of the bearing block 229 to the print-off position, when movement of the bearing block 229 is not impeded in some other way. An adjustment to the print-on position is accomplished by moving the bearing block 229 in the direction of the stop 233 by the utilization of at least one actuator 232, and especially by the utilization of a power-controlled actuator 232, with which a defined or a definable force F can optionally be applied to the bearing block 229 in the print-on direction for the purpose of engaging the respective cylinder 06; 07. If this force F is greater than the restoring force $F_R$ of the spring elements 237, then, with a corresponding spatial configuration, an engagement of the respective cylinder 06; 07 against the adjacent cylinder 06; 07 and/or an engagement of the bearing block 229 against the stop 233 occurs.

Ideally, the applied force F, the restoring force $F_R$ and the position of the stop 233 are selected such that between the stop 233 and the stop surface of the bearing block 229, in the engaged position, no substantial force ΔF is transferred, and such that, for example, $|\Delta F|<0.1*(F-F_R)$, especially $|\Delta F|<0.05*(F-F_R)$, ideally $|\Delta F|\approx 0$. In this case, the engagement force between the cylinders 06; 07 is essentially determined by the force F that is applied via the actuator 232. The linear force $F_L$ at the respective nip point, which linear force $F_L$ is decisive for ink transfer and therefore for print quality, among other factors, is therefore defined primarily not by an adjustment path S, but, in the case of a quasi-free stop 233, by the force F and the resulting equilibrium. In principle, once the basic adjustment has been determined with the forces F appropriate for this, a removal of the stop 233, or of a corresponding immobilization element, that is effective only during the basic adjustment, would be conceivable.

In principle, the actuator 232 can be embodied as any actuator 232 that will exert a defined force F. Advantageously, the actuator 232 is configured as a positioning element 232 which can be actuated with pressure medium, and especially can be configured as a piston 232 that can be moved by a fluid. Advantageously, with respect to a possible tilting of the bearing block 229, the assembly comprises multiple actuators 232 of this type. In the embodiment shown in FIG. 19, this case there are provided two such actuators. A liquid, such as oil or water, is preferably used as the fluid, essentially due to its incompressibility.

To actuate the actuators 232, which are both embodied in this case as hydraulic pistons 232, a controllable valve 238 is provided in the bearing unit 224. The controllable valve 238 is configured, for example, as being electronically actuable, and places a hydraulic piston 232 in a first position to be pressureless or at least at a low pressure level. In another position of valve 238, the pressure 2P, which conditions the force F, is present. In addition, for safety purposes, a leakage line, which is not specifically shown in FIG. 19, is provided.

To prevent excessively long engagement/disengagement paths, while still protecting against web wrap-up, on the side of the bearing block 229 that is distant from the print position, a restriction of movement by a movable, force-limited stop 239, as an overload protection element 239, for example in combination with a spring element, can be provided. In the operational print-off position, in which the pistons 232 are disengaged and/or are retracted, this stop 239 can serve as a stop 239 for the bearing block 229. In the case of a web wrap-up, or of other excessive forces originating from the print position, stop 239 will yield and will open up a larger path of movement of the bearing block 229 away from the cylinder engagement position. A spring force for this overload protection element 239 is therefore selected to be greater than the sum of the forces of the spring elements 237. Thus, in operational engagement/disengagement, a very short adjustment path of, for example, only 1 to 3 mm, can be provided.

In the represented embodiment shown in FIG. 19, the stop 233 is embodied as a wedge 233, which can be moved transversely in relation to the direction of adjustment path S. In the movement of this wedge stop 233, the position of the respective active stop surface 234, along the path of adjustment S, varies. The wedge 233 is supported, for example, against a stop 241 which is fixed to the support opposite to the overload projection element 239.

The stop 233, which is embodied in the direction of FIG. 19 as wedge 233, can be moved by an actuator 236, such as, for example, by a positioning element 236 which can be actuated with pressure medium. Actuator 236 can thus be, for example, a piston 236 which is actuable with a pressure medium, in a working cylinder with preferably dual-action pistons, via a transmission element 242, which may be embodied, for example, as a piston rod 242, or by an electric motor via a transmission element 242, which can be embodied as a threaded spindle. This actuator 236 can be active in both directions or, as illustrated in FIG. 19, can be configured as a one-way actuator, which, when activated, works against a restoring spring 243. For the aforementioned reasons, primarily for the provision of a largely power-free stop 233, the force of the restoring spring 243 is selected to be weak enough that the wedge 233 is held in its correct position against only the force of gravity or vibrational forces.

In principle, the stop 233 can also be embodied differently, such as, for example, as a ram that can be adjusted and can be affixed in the direction of adjustment, such that it forms a stop surface 234 for the movement of the bearing block 229 in the direction of the print position. The stop surface can variable in the direction of the adjustment path S and, at least during the adjustment process, can be secured in position. In an embodiment which is not specifically illustrated, the stop 233 can be adjusted, for example, directly parallel to the direction of adjustment path S via a drive element, such as, for example, by the use of a cylinder that is actuable with pressure medium, with pistons or with an electric motor.

Reference will now be made to the embodiment of the present invention which is depicted in FIGS. 20 through 24. In the interest of avoiding repetition, reference will be made exclusively to the description in connection with the embodiments of FIG. 1 through 19, to the extent that this is applicable. The embodiments of FIG. 20 through 24 differ from the embodiments of FIG. 1 through 19 especially or significantly primarily in terms of a different configuration of the first end 103 of the printing plate 101, as may be seen, for example, in FIG. 21, which different plate end configuration includes a correspondingly different structure for the printing plate holding device in the plate cylinder 07 and for the cylinder groove 108 as may be seen in, for example FIG. 22, and in terms of a different plate change plan as is depicted schematically in FIG. 20 and also in FIG. 24.

Figure 21:
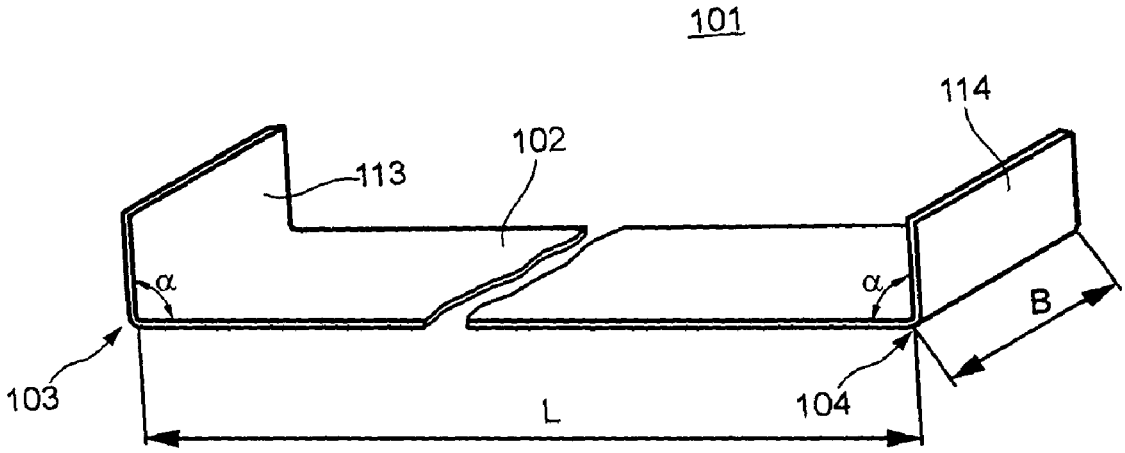
FIG. 21 a perspective view of a printing plate, for use in conjunction with the plate cylinders of the printing tower of FIG. 20, for example.

FIG. 21 shows a preferred embodiment of a plate-type printing plate 101 which is made of a flexibly deformable metal. As in the case of the previously discussed, preferred embodiment of FIG. 3, plate 101 can have a length L of, for example, between 400 mm and 1,300 mm and a width B of between 280 mm and 1,500 mm. When mounted, the printing plate 101 rests with a contact surface 102 on the circumferential surface of a plate cylinder 07. The printing plate 101 has two opposite ends 103; 104 with angled suspension legs 113; 114. The leading suspension leg 113 of a first, leading end 103 is angled at an angle α, and the trailing suspension leg 114 of a second, trailing end 104 can be angled at the same angle α. The two angles α may, however, also be different in size.

The angle α is preferably at least substantially a right angle. The angle α can range from 80° to 100°, but is preferably a right angle at for example, 90°.

Figure 22:
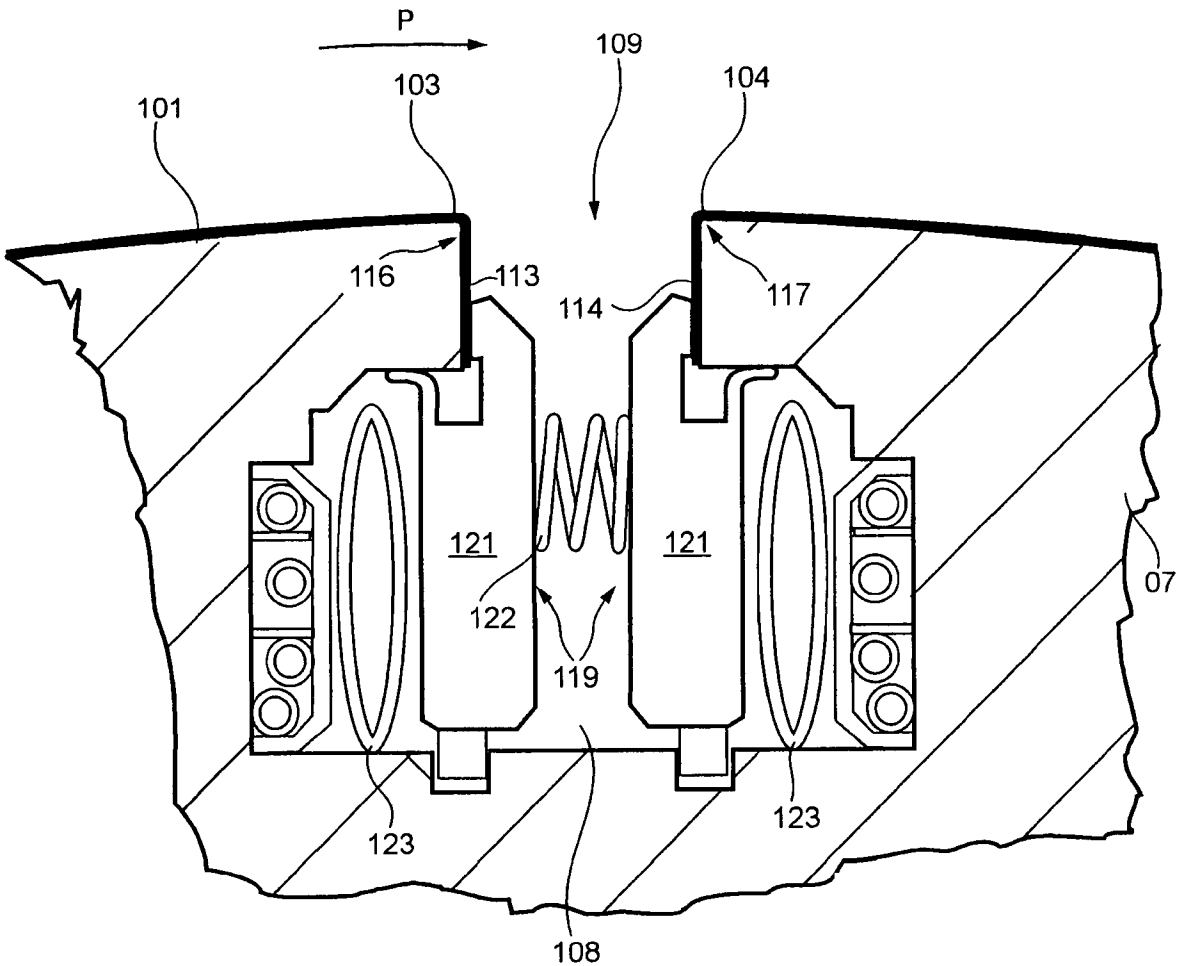
FIG. 22 a schematic cross-section of a holding device for a printing plate that is mounted, for example, on a plate cylinder of the printing tower of FIG. 20.

As is shown in FIG. 22, the suspension legs 113; 114 of the printing plate 101 are each fastened by a plate end holding device 119, which can correspond, in overall structure and operation at least substantially to the holding device 119 of FIG. 4. The two holding devices 119 are configured symmetrically with respect to a center plane of the cylinder groove 108, which cylinder groove 108 is also symmetrically configured.

The plate end suspension legs 113; 114, which are both angled at substantially right angles, can be inserted into a relatively narrow, and especially into a slit-shaped, opening 109 formed in the groove 108 of the cylinder 07, where they can each be fastened via one of the holding devices 119, which can be embodied as clamping devices as are shown in FIG. 22.

The suspension leg 113 at the leading end 103 of the printing plate 101, which leg 113 is angled at least substantially at a right angle, can be suspended from the front edge 116 or front suspension edge 116 of the opening 109. That edge is configured at least substantially as a right angle. The suspension leg 114 at the trailing end 104 of the printing plate 101, which leg 114 is angled at least substantially at a right angle, can be suspended from the rear edge 117 or rear suspension edge 117 of the opening 109. That edge is also configured at least substantially as a right angle.

At least one pivotably mounted holding assembly 121 and a shared spring element 122, which is prestressed between the two holding assemblies 121, are arranged in the groove 108 for each holding device 119, for example. The spring element 122 forces each holding assembly 121, for example, against a respective angled suspension leg 113; 114 at the leading end 103 or at the trailing end 104 of the plate 101, which is suspended from the opening 109 at its front edge 116 or at its rear edge 117. The suspension leg 113 at the leading plate end 103 or the suspension leg 114 at the trailing plate end 104 is held in position on the wall that extends from the front edge 116 or from the rear edge 117 up to the groove 108. To release the pressure exerted by the respective holding assemblies 121, an actuating device 123 is provided in each groove 108. This is preferably a pneumatically actuable actuating device 123, which, when it is actuated, pivots the respective holding assembly 121 against the force of the spring element 122 and releases the suspension leg 113 or 114. Therefore, the holding device 119, which is described by way of example, consists substantially of the two holding assemblies 121, the spring element 122 stressed between these, and the two actuating devices 123.

Figure 20:
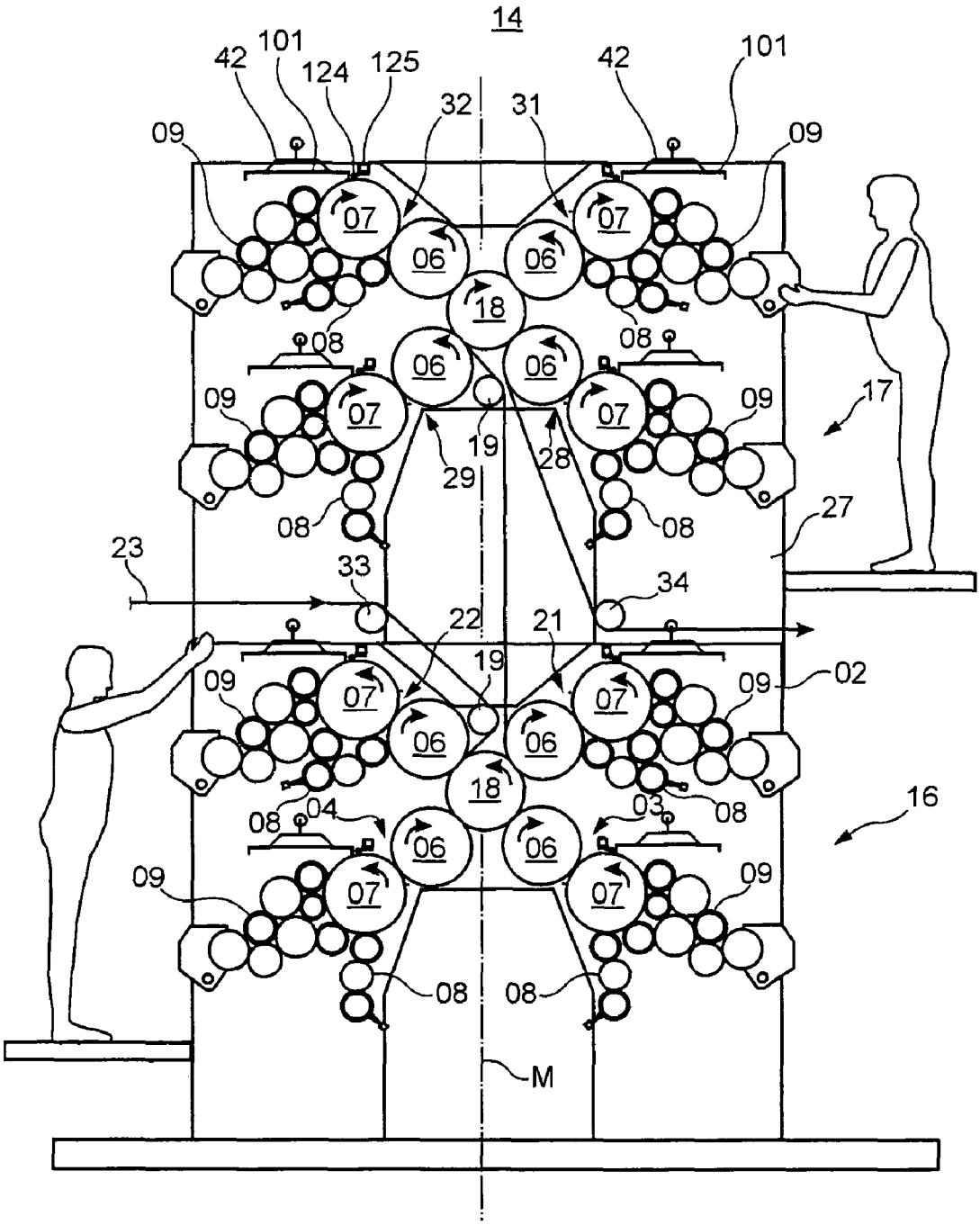
FIG. 20 a schematic side elevation view of another embodiment of an eight-couple tower with two nine-cylinder satellite printing units arranged one above another.

The plate changing process, in accordance with the preferred embodiment of FIG. 20 through FIG. 22, in the cases in which the production direction P is the same as the general direction in which the printing plates 101 are supplied, in other words in the case of printing couples 03; 21; 29; 32, is different than it is in the cases in which the production direction P is not the same as the general direction in which the printing plates 101 are supplied, in other words in the case of printing couples 04; 22; 28; 31. In the latter case, the direction of rotation of the respective plate cylinder 07 is reversed during the implementation of the procedure for mounting the printing plates 101, as was described previously in connection with the first embodiment. This will be described again, with reference to FIG. 23.

Once again, it will be assumed that in the nine-cylinder satellite printing unit 16, which may be seen, for example, in FIG. 20, the web of print substrate 23 will be printed sequentially in printing couple 22 with the color black, in printing couple 04 with the color cyan, in printing couple 03 with the color magenta and in printing couple 21 with the color yellow. Accordingly, in FIG. 23 printing plates 101*a*; 101*b*; 101*c* and 101*d*, which are respectively assigned to printing couples 22; 04; 03; 21, carry print images for the corresponding colors. The printing plates 101*a* which are assigned to printing couple 22 carry a print image 105*a* for the color black. The printing plates 101*b* which are assigned to printing couple 04 carry a print image 105*b* for the color cyan. The printing plates 101*c* which are assigned to printing couple 03 carry a print image 105*c* for the color magenta. The printing plates 101*d* which are assigned to printing couple 21 carry a print image 105*d* for the color yellow.

Figure 23:
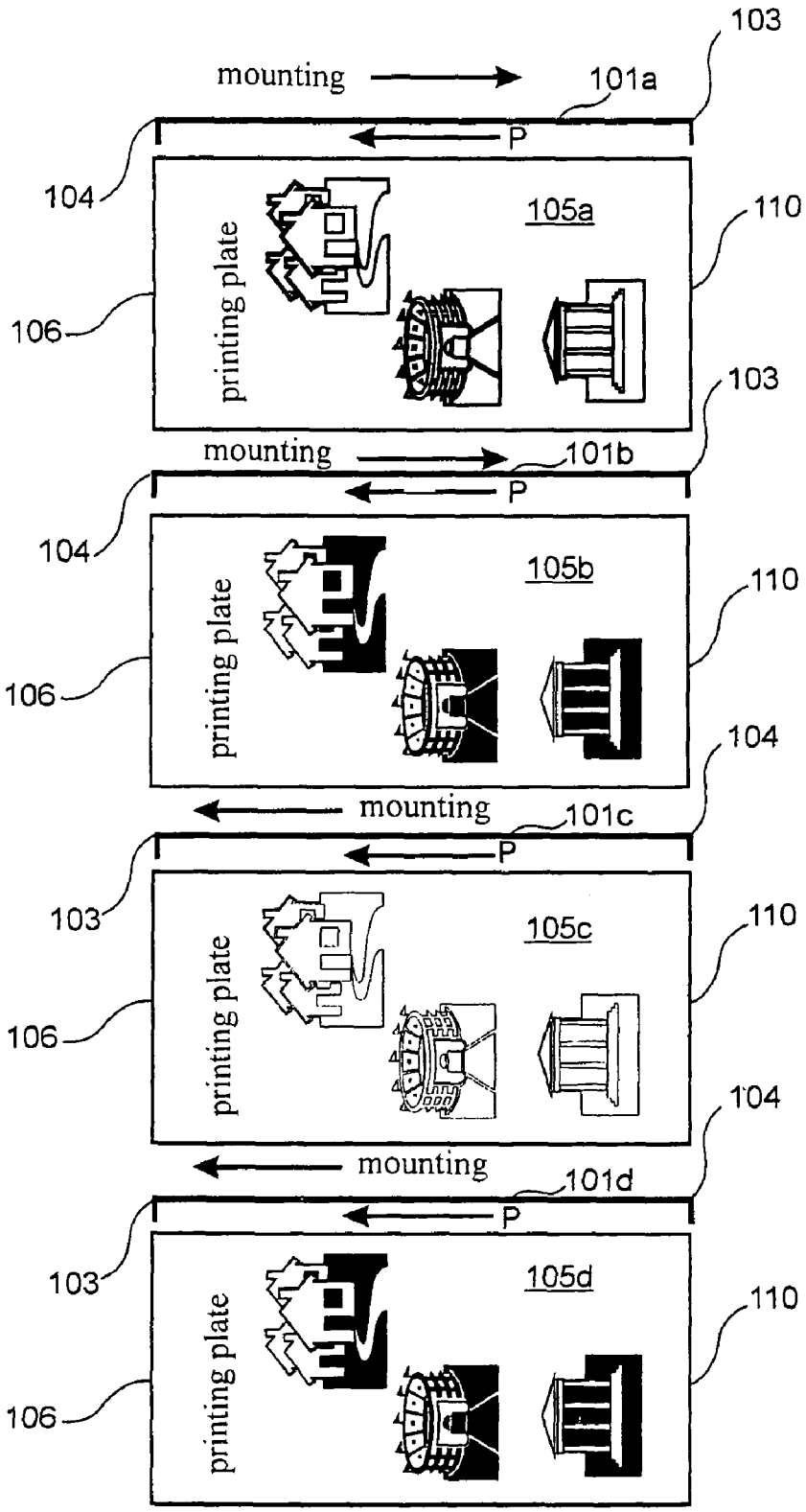
FIG. 23 a representation of the different orientations of the printing plates and/or of the print images applied to these, in the example of a four-color printing process, for example in a nine-cylinder satellite printing unit in accordance with FIG. 20.

FIG. 23 shows a diagram of the printing plates 101*a*; 101*b*; 101*c* and 101*d* along with the assigned print images 105*a*; 105*b*; 105*c* and 105*d* for this nine-cylinder satellite printing unit 16. The orientation of the print images 105*a*; 105*b*; 105*c* and 105*d*, relative to the respectively assigned printing plates 101*a*; 101*b*; 101*c* and 101*d*, is also indicated. The respective arrows indicate the production direction P or running direction P of the respective printing plates 101*a*; 101*b*; 101*c* or 101*d* on the corresponding plate cylinder 07 during production operation. The leading end of each print image 105*a*; 105*b*; 105*c*; 105*d* during production operation is identified by the reference symbol 106, and the trailing end in the production process is identified by the reference symbol 110.

The process of mounting the printing plates 101*a*; 101*b*, in the case of printing couples 22 and 04, for example, is implemented such that the second end 104 of each of the corresponding printing plates 101*a*; 101*b* is first suspended from the first rear edge 117 of the plate cylinder 07 and is fastened via the holding device 119. During this process, the direction of rotation of the corresponding plate cylinder 07 is reversed and is thus now opposite to the production direction in order to mount the printing plates 101*a*; 101*b*, until the second end 103 of each of the printing plates 101*a*; 101*b* is also suspended from and fastened on the second front edge 116 of the plate cylinder 07. The direction of rotation of the plate cylinder 07 is then reversed and is again returned to the production direction P for a subsequent print operation. Thus the trailing end 104 of the printing plate 101*a* or 101*b*, in production operation, is the first to be mounted during a plate change or mounting of a printing plate 101*a*, 102*b* on the printing cylinder 07.

As is indicated in FIG. 23, in this case, the direction of rotation of the cylinder 07 during plate mounting is opposite to the production direction P of the cylinder 07 during production. In the case of printing plates 101*c*; 101*d*, such as are applied to printing couples 03; 21, in contrast, the direction of rotation of the cylinder 07 during mounting is the same as the production direction P of the cylinder 07 during production. The leading end 103 of the printing plate 101*c*; 101*d*, during production, is the first to be mounted on the cylinder 07.

The above-described procedures can also be applied correspondingly to the upper nine-cylinder satellite printing unit 17. Here, the printing couples 31; 28 are those printing couples 31; 28 in which the printing plates 101*c* and 101*d* have leading first ends 103 in print operation and which carry applied print images 105*c*; 105*d*. In the case of the nine-cylinder satellite printing unit 17 of the described preferred embodiment, these printing couples are assigned the colors magenta and yellow 31; 28, respectively.

Figure 24:
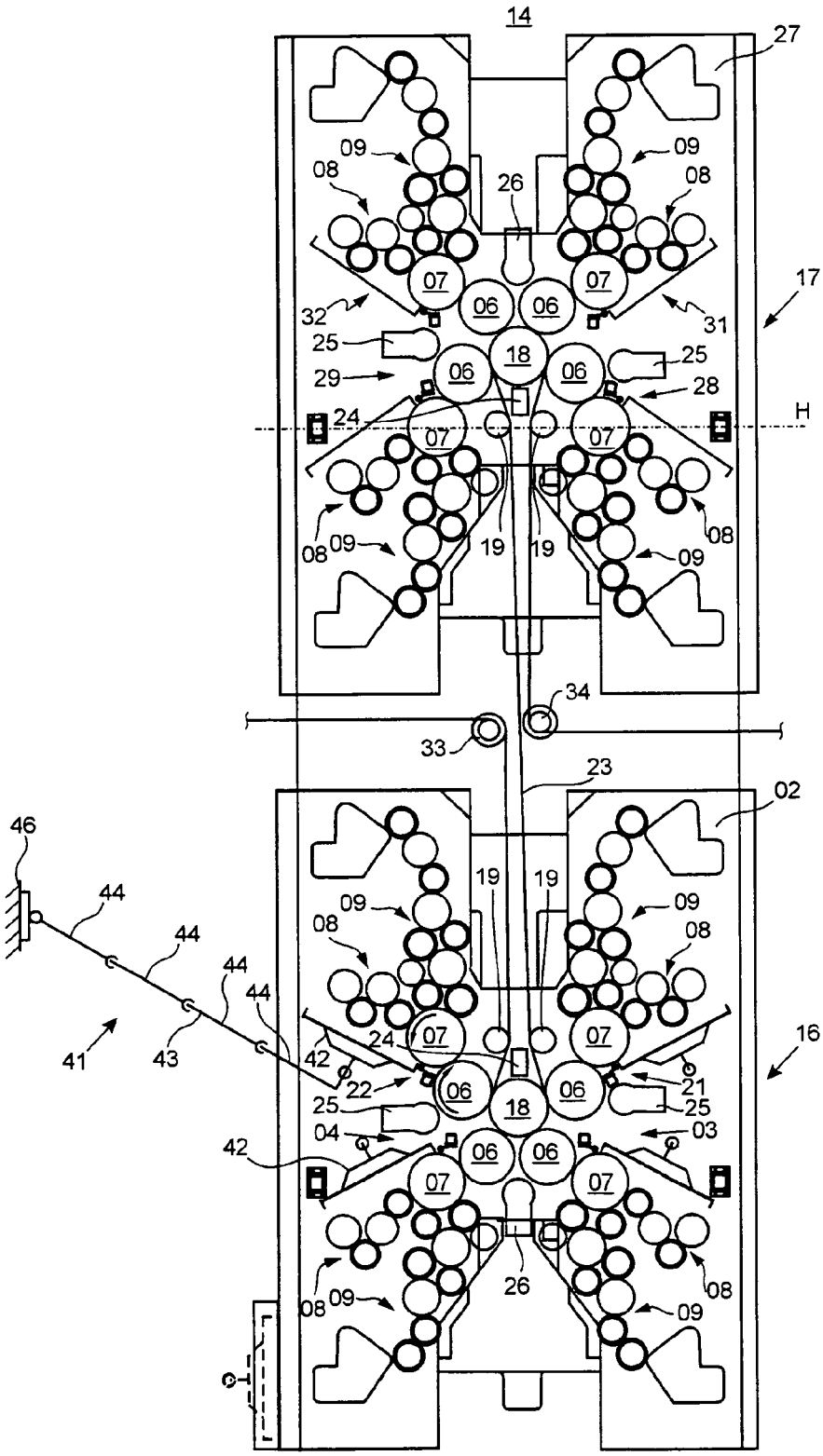
FIG. 24 a schematic side elevation view of another embodiment of an eight-couple tower with two nine-cylinder satellite printing units arranged one above another, and having plate changing devices for all of the plate cylinders, wherein in this embodiment, however, the plate change is partially performed when the plate cylinders are in lower positions.

With the printing tower 14 of FIG. 24, the printing plates 101 are mounted on the respective plate cylinders 07 in the same manner as has been described above. In the printing tower 14 of FIG. 24, which is also comprised of two vertically stacked nine-cylinder satellite printing units 16 and 17, the arrangement of the inking units 09 and the dampening units 08 on the respective plate cylinders 07 is somewhat different from the corresponding arrangements of FIG. 20 or 1 and 2, and is conditioned, among other factors, by the arrangement and the position of additional washing devices 24; 25; 26. Moreover, in contrast to the preceding preferred embodiments, the printing plates 101 are no longer supplied substantially horizontally. Instead, they are supplied at an angle, and furthermore, the printing plates 101 in the case of printing couples 21; 22; 31; 32 are brought to a position at the bottom of the plate cylinder 07 for the purpose of mounting. With printing couples 04; 21; 28 and 32, the direction of rotation of the plate cylinder 07 is reversed when a printing plate 101 is being mounted on the plate cylinder 07.

In the preferred embodiments of FIG. 20 through 24, the concept of the device for changing plates differs from that of the preferred embodiments of FIG. 1 through 19. It should be noted, however, that the concept for the embodiments of FIG. 20 through 24, as will be described in what follows, can also be implemented, in principle, in the embodiments of FIG. 1 through 19, and vice versa.

Specifically, for a printing plate change, at least one manipulation device 41 is provided, which comprises at least one gripper element 42. The manipulation device 41 can comprise a movable arm 43, which supports the gripper element 42 at its end. The movable arm 43 can be configured with multiple axes and can be remotely controllable. The movable arm 43 can be embodied preferably as a robotic arm 43. As is indicated in FIG. 24, the movable arm 43 can comprise a plurality of elements 44 which may be connected to one another via joints.

The gripper element 42 can preferably be embodied as a suction element 42, and can optionally comprise a plurality of suction elements. The suction element 42 can especially hold a printing plate 101 at its center.

A manipulation device 41 with a plurality of gripper elements 42 can be provided, especially as a manipulation device 41 with a plurality of gripper elements 42 arranged side by side, and which are usable for the simultaneous gripping of a plurality of printing plates 101 that are arranged side by side in an axial direction of the cylinder 07. In this case, the axially spaced gripper elements 42 for each such printing plate 101 can be separately controllable, especially with respect to gripping and releasing. Specifically, a robotic arm 43 can carry a plurality of suction elements 42 for this purpose, which suction element 43 can be activated via control lines that are not specified in greater detail.

A separate manipulation device 41 can be arranged on each of the respective printing couples 03; 04; 21; 22; 28; 29; 31; 32. The manipulation device 41 can also, however, be arranged on an adjacent printing couple, for example of an adjacent printing tower 46 or an adjacent printing unit 46. Alternatively, the manipulation device 41 can be arranged between two printing couples, printing units or printing towers, and can optionally be centered between these, and can, for example, be fastened to a cross member 46. The manipulation device 41 can also be embodied to be movable. For example, it can be movable in a vertical direction, so as to service different printing couples or printing units.

A manipulation device 41 can be provided for each printing couple 03; 04; 21; 22; 28; 29; 31; 32. Alternatively, and preferably, one manipulation device 42 can be provided for use with at least two printing couples, such as, for example, for use with two printing couples 04; 22 or 29; 32 which are arranged one above another. A manipulation device 41 can be provided for servicing more than two printing couples, such as, for example, for servicing four or more printing couples, and especially for servicing four printing couples of two adjacent printing units 16 or 17 situated side by side, or of two printing units 16; 17 that are arranged one above another.

For mounting the printing plates 101, in addition to the manipulation device 41 or the manipulation devices 41, contact pressure elements 124, such as, for example, in the form of contact rollers 124 are also provided, as they were in the case of the embodiments of FIG. 1 through 19. This type of contact roller 124 is assigned to each printing couple 03; 04; 21; 22; 28; 29; 31; 32. The contact rollers 124 can each be arranged on stationary cross members 125, and can, for example, be pneumatically remotely actuable.

While preferred embodiments of a method for operating a printing unit having at least one printing couple, and a printing couple for implementing the method have been described fully and completely hereinabove, it will be apparent to one of skill in the art that various changes in, for example, the assemblies for supplying the webs to be printed, the locations of the printing couples, the types of ink being used and the like could be made without departing from the true spirit and scope of the present invention which is accordingly to be limited only by the appended claims.

The invention claimed is:

1. A method for operating a printing press comprising:

providing a nine-cylinder satellite printing unit having four printing couples, each with a plate cylinder:

providing each of the four plate cylinders with a position-controlled drive motor so as to be positively driven;

supporting a first plate cylinder of a first lower printing couple for rotation in a production direction and in a plate mounting direction;

supporting a second plate cylinder of a second lower printing couple for rotation in a production direction and in a plate mounting direction;

providing at least one printing plate having at least one print image thereon and adapted to be mounted on each of said first and second plate cylinders;

providing at least one axially extending printing plate end receiving groove in each of said first and second plate cylinders;

providing each of said at least one printing plate to be mounted on each of said first and second plate cylinders with an angled first end which, in said production direction of rotation of each of said first and second plate cylinders, is a leading end;

providing each said at least one printing plate to be mounted on each of said first and second plate cylinders with an angled second end which, in said production direction of rotation of each of said first and second plate cylinders, is a trailing end;

fastening said second, trailing end of said at least one printing plate in said printing plate end receiving groove of said first plate cylinder, while rotating said first plate cylinder in said plate mounting direction and selecting said plate mounting direction to be opposite of said production direction of said first plate cylinder;

fastening said first, leading end of said at least one printing plate in said printing plate end receiving groove of said first plate cylinder while rotating said first plate cylinder in said mounting direction;

fastening said first, leading end and said second, trailing end of said at least one printing plate in said printing plate end receiving groove of said second plate cylinder, while rotating said second plate cylinder in said mounting direction and selecting said plate mounting direction of said second plate cylinder to be the same as said production direction of said second plate cylinder; and subsequently rotating said first and second plate cylinders in said production direction to carry out printing operations.

2. The method according to claim 1, further including providing a plate changing device and wherein the printing plates are each supplied and removed by said plate changing device, said plate changing device having a horizontal plane that forms an angle smaller than 15° and having at least two chute-like areas arranged side by side.

3. The method according to claim 2, further including using said plate changing device and supplying the printing plates, using the plate changing devices, to an upper area of the first and second plate cylinders of the first and second lower printing couples.

4. The method according to claim 1, further including angling a suspension leg on the first end of each said printing plate at an opening angle of 35° to 55°.

5. The method according to claim 1, further including angling a suspension leg on the second end of each said printing plate at an opening angle of 80° to 100°.

6. The method according to claim 1, further including angling both the first end and the second end of each said printing plate at least substantially at a right angle ($\alpha$).

7. The method according to claim 1, further including angling both the first end and the second end of each said printing plate at an angle ($\alpha$) of between 80° and 100°.

8. The method according to claim 7, further including angling both the first end and the second end of each said printing plate at an angle ($\alpha$) of 90°.

9. The method according to claim 1, further including angling the first end and the second end of each said printing plate at the same angle ($\alpha$).

10. The method according to claim 1, further including rotating the four plate cylinders of the four printing couples of the nine-cylinder satellite printing unit in the same rotational direction during print operation.

11. The method according to claim 10, further including reversing the direction of the four plate cylinders in order to mount the printing plates on the plate cylinders arranged on one of the two sides of the nine-cylinder satellite printing unit.

12. The method according to claim 11, further including reversing the direction of rotation for the plate cylinders to which the colors black and cyan or the colors magenta and yellow are assigned.

13. The method according to claim 10, further including positively driving each said plate cylinder via a position-controlled drive motor, independently of a satellite cylinder.

14. The method according to claim 1, further including providing each plate cylinder as having two, three, four, five, six or eight printing plates arranged side by side in an axial direction.

15. The method according to claim 1, further including providing the at least one print image having an end that is leading in print operation and an end that is trailing in print operation.

16. The method according to claim 1, further including providing an upper area of each plate cylinder and supplying each of the printing plates to the upper area of the assigned plate cylinder.

17. The method according to claim 1, further including at least one printing plate manipulation device having at least one gripper element and carrying out a printing plate change using said at least one manipulation device having said at least one gripper element.

* * * * *